US007841222B2

(12) United States Patent
Cook et al.

(10) Patent No.: US 7,841,222 B2
(45) Date of Patent: Nov. 30, 2010

(54) CONTAINER END FORMING SYSTEM

(75) Inventors: Stephen T. Cook, Miamisburg, OH (US); Dale R. Conley, Bellbrook, OH (US); Mark F. Broerman, Dayton, OH (US)

(73) Assignee: Dayton Systems Group, Inc., Miamisburg, OH (US)

( * ) Notice: Subject to any disclaimer, the term of this patent is extended or adjusted under 35 U.S.C. 154(b) by 839 days.

(21) Appl. No.: 10/569,910

(22) PCT Filed: Aug. 30, 2004

(86) PCT No.: PCT/US2004/028123

§ 371 (c)(1),
(2), (4) Date: Feb. 12, 2007

(87) PCT Pub. No.: WO2005/021388

PCT Pub. Date: Mar. 10, 2005

(65) Prior Publication Data

US 2007/0266755 A1 Nov. 22, 2007

Related U.S. Application Data

(60) Provisional application No. 60/498,557, filed on Aug. 28, 2003.

(51) Int. Cl.

| | |
|---|---|
| ***B21D 17/02*** | (2006.01) |
| ***B21D 11/00*** | (2006.01) |
| ***B21D 7/06*** | (2006.01) |
| ***B21J 9/18*** | (2006.01) |

(52) U.S. Cl. ..... 72/379.4; 72/407; 72/450; 72/414

(58) Field of Classification Search ..... 72/91, 72/94, 379.4, 379.2, 105, 715, 120–126, 72/431–432, 407, 411–416, 450–451, 414, 72/409.18; 413/8, 69, 76
See application file for complete search history.

(56) References Cited

U.S. PATENT DOCUMENTS

| | | | |
|---|---|---|---|
| 1,728,274 | A | 9/1929 | Hammer |
| 1,854,170 | A | 4/1932 | Hermani |

(Continued)

FOREIGN PATENT DOCUMENTS

| | | |
|---|---|---|
| JP | 58 020341 | 2/1983 |

(Continued)

OTHER PUBLICATIONS

EP 04 78 2572.4 Supplementary European Search Report, mailed Jul. 30, 2009.

*Primary Examiner*—Dana Ross
*Assistant Examiner*—Mohammad Yusuf
(74) *Attorney, Agent, or Firm*—Fay Sharpe LLP

(57) ABSTRACT

Thread lug forming systems form thread lugs (36) on container necks or necked end domes. A continuously rotating cam system (100) has multiple sets of thread lug forming tools (135) which are driven to recirculate about stationary cams (130). The cams actuate inner and outer forming tools (150, 152) of the tool sets as they progress around the cams to form the thread lugs. A second system uses generally the same tool sets in a multiple-station reciprocating press (203), and the container bodies are indexed through the tool stations (252) in which the thread lugs are formed.

11 Claims, 21 Drawing Sheets

U.S. PATENT DOCUMENTS

| | | | |
|---|---|---|---|
| 2,313,748 | A | 3/1943 | Hothersall |
| 2,348,464 | A | 5/1944 | Geertsema |
| 2,398,373 | A | 4/1946 | Grotnes |
| 6,015,062 | A | 1/2000 | Bachmann et al. |
| 6,082,944 | A | 7/2000 | Bachmann et al. |
| 2004/0129709 | A1 | 7/2004 | Cook et al. |
| 2005/0138984 | A1 | 6/2005 | Cook et al. |
| 2006/0011633 | A1 | 1/2006 | Cook et al. |

FOREIGN PATENT DOCUMENTS

| | | | |
|---|---|---|---|
| JP | 63 123606 | | 5/1988 |
| JP | 2003 154426 | | 5/2003 |
| JP | 2003 191014 | | 7/2003 |
| WO | WO 0158618 | * | 8/2001 |

* cited by examiner

CONTAINER END FORMING SYSTEM

RELATED APPLICATIONS

This application claims the benefit of PCT Patent Application Ser. No. PCT/US04/028123, filed on 30 Aug. 2004, and claims the benefit of U.S. Provisional Patent Application Ser. No. 60/498,557, filed on Aug. 28, 2003, the disclosures of which are incorporated herein by reference.

BACKGROUND OF THE INVENTION

This invention relates to containers particularly for material such as beverages and other liquids, powdered materials, foods, various liquids over a range of viscosity, etc. and more particularly to unique components of container ends and methods of forming such components. The elements of such ends include end structure formed as an upper part of a container body, either by attachment of the end structure to a container body by various means such as bonding or seaming, or as an integral part of a container body, and to a reclosable cap for such end structures. U.S. Pat. No. 6,015,062 issued 18 Jan. 2000 and U.S. Pat. No. 6,082,944 issued 4 Jul. 2000, both assigned to the same assignee as this application, disclose earlier forms of such a container wherein a detachable lugged cap is fitted to the top of a neck or spout of a an initially independent end structure, e.g. a dome structure or the like, which is combined with a container body, and to a system for making them. The cap forming tools and system are the subject of an International Patent Application entitled LUGGED CAP FORMING SYSTEM, Serial No. PCT/US01/49,392 filed 20 Dec. 2001, published 27 Jun. 2002. Details of that system are not specifically related to the present invention.

The invention herein described is also related published to International Application No. PCT/US02/06046 filed 27 Feb. 2002, entitled DOME FORMING SYSTEM, and to the National application based thereon and filed on the same date as this application. That application discloses a system in which domes, designed to be attached to container bodies, are completely formed using cooperating upper and lower progressive tolls in a reciprocating press. The last few of those tool sets form the thread lugs in the necks of the domes. The thread lugs may include the features disclosed in published International Application No. PCT/US03/20283 filed 26 Jun. 2003, entitled VENTING LUG CAP. It has been determined that separating the thread lug forming function from that system, in addition to simplification, allows the thread lug formation to be performed with upper tools alone in a separate system which can be utilized to formed thread lugs in the necks of domes or in necks formed as integral parts of a container body.

SUMMARY OF THE INVENTION

The present invention relates to an improved system (method and apparatus) for forming or constructing an end with thread lug parts upon the open end of a metal container body, typically a metal can body drawn or extruded from aluminum, or constructed from so-called tin plate or similar thin metal suitable for cans. The containers can be capable of keeping the product with which they are filled under pressure, or under a vacuum, or at generally ambient (but sealed) pressure.

A principal object of this invention is to provide such an improved end construction as an integral part of a container body to which a lugged cap may be attached and sealed. This invention also provides improved methods of and apparatus for making the improved end on a container at commercially acceptable speeds, and particularly to the formation of integral thread lugs in the neck of the end structure to which the cap is attached and removed and replaced after initial opening.

In particular, the thread lugs are formed on the necks of container end structures by progressively operating tooling which is part of a system, particularly a rotary system, that receives container bodies with a preformed neck, or domes for attachment to container bodies, and forms the thread lugs as an integral part of such neck, with the thread lug dies entering into and retracting from the neck via the rim (or spout opening) of the neck.

In a similar system employing a reciprocating press type of machine, similar tooling is provided for forming thread lugs into necked container parts (e.g. domes) and/or neckcontainer bodies, in a sequential fashion. This alternate system employs a unique feeding mechanism for necked parts and/or containers, which is adaptable to a range of heights of the parts and/or container bodies.

Other objects and advantages of the invention will be apparent from the following description, the accompanying drawings and the appended claims.

DESCRIPTION OF PREFERRED EMBODIMENTS

Figure 1:
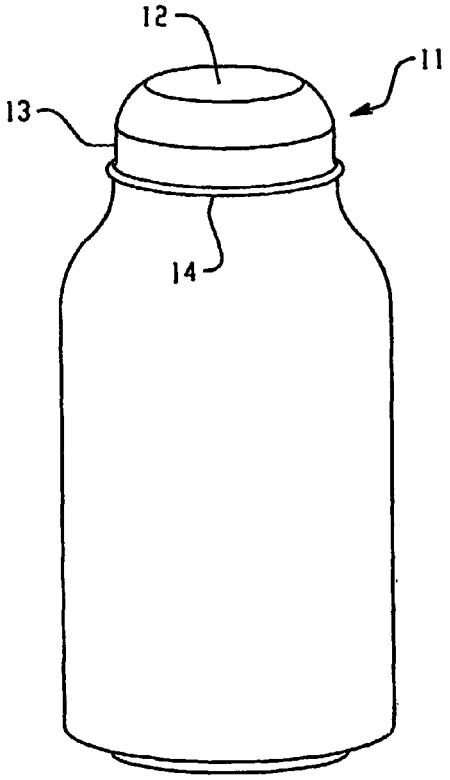
FIG. 1 is a perspective view of one form of a container and cap, intended for liquids and/or fluid materials, including a top or dome structure having a neck onto which multiple thread lugs are formed according to the invention.
Figure 2:
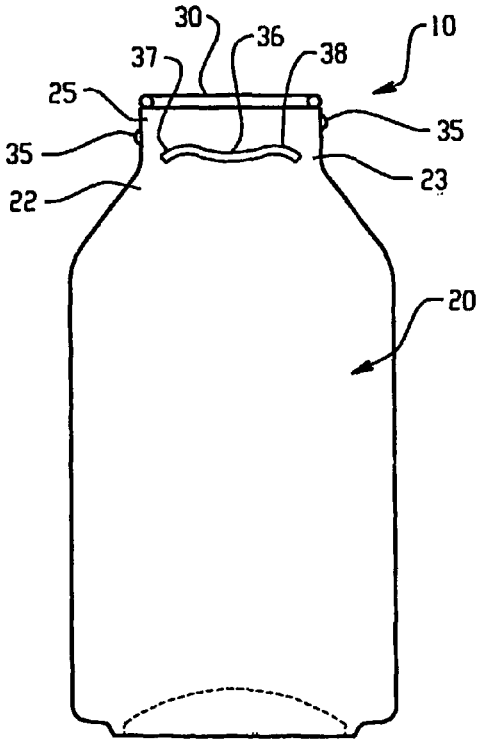
FIG. 2 is a side view of the container of FIG. 1 with the cap removed, showing the neck and thread lugs.
Figure 3:
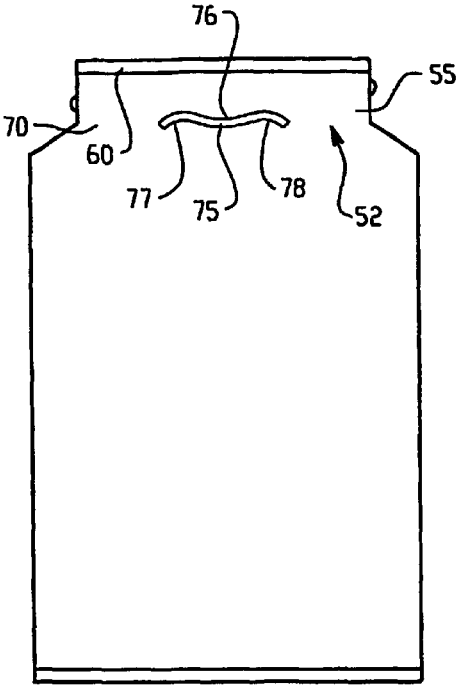
FIG. 3 is a view of another form of container body, intended for a variety of foods, having a generally cylindrical neck of greater diameter defining an opening at its upper end, onto which neck the thread lugs are formed.
Figure 4:
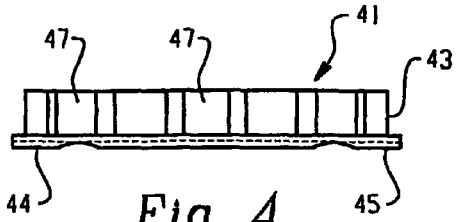
FIG. 4 is a side view of a cap for the container body shown in FIG. 3.
Figure 5:
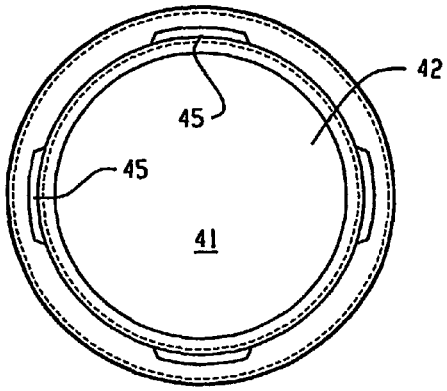
FIG. 5 is a top view of the cap illustrated in FIG. 4.
Figure 6:
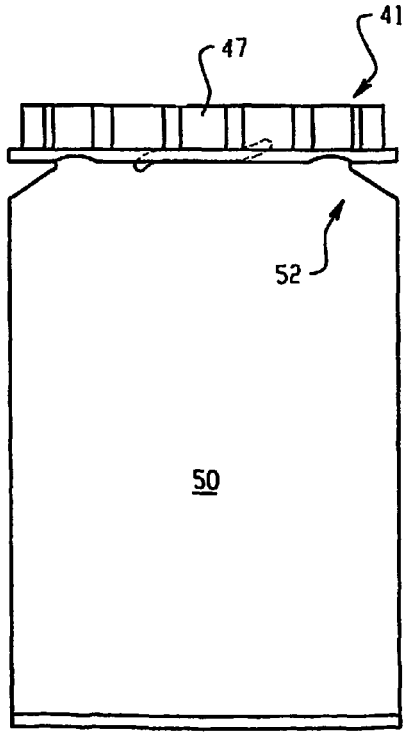
FIG. 6 is a view of the container shown in FIG. 3, with the cap of FIG. 4 attached to the container top.

Referring to FIGS. 1 & 2, a container type as provided by the present invention is comprised of two major parts, a end structure 10, and a cap member 11 which is in the general form of an inverted cup including a top panel 12 and a cylindrical side 13 depending from top panel 12 of the cap member. A curled rim 14 is formed on the lower edge of side 13, and has inwardly extending cap lugs formed thereon.

The unique end structure 10, according to this invention, is formed as an integral part of the upper end of a can body 20. It includes a central end section 22 formed on the top of can body 20, which is shown as an integral piece, but may be a two-piece structure if desired. Extending from the upper edge 23 of section 22 is a cylindrical neck or spout section 25 which terminates at its upper edge in a curled seal rim 30. The rim 30 is intended to contact an elastomeric seal, typically fitted within or formed upon the underside of cap panel 12. Rim 30 can function as an opening for drinking or a pour opening for dispensing contents of the container, and also provides a fill opening.

Extending outward from the side of upper neck section 25 is a set of horizontally elongated multiple thread lugs 35 (see FIG. 2), shown (by way of example and not limitation) as four in number. Each thread lug includes a central part 36 extending generally parallel to and at a predetermined distance below the curl rim 30, downward extending stop parts 37 and upward extending entrance parts 38. The thread lugs extend for a predetermined length partly around the neck, leaving spaces between the thread lugs for passage of the cap lugs during closing and opening. Thread lugs 35 cooperate with the inwardly extending cap lugs to hold a cap firmly on the seal rim 30. A cap is attached to the upper neck portion, and rotated causing the cooperating thread lugs and cap lugs to draw the cap top panel 12 and its seal against seal rim 30.

FIGS. 3-6 illustrate another form of container having an end structure 40, and a cap member 41 which is in the general form of an inverted cup including a top panel 42 and a cylindrical side 43 depending from top panel 42 of the cap member. A curled rim 44 is formed on the lower edge of side 43, and has inwardly extending cap lugs 45 formed thereon. The exterior of cap member 41 may be provided with facets 47 to enhance gripping of this larger diameter cap.

The unique end structure 40, according to this invention, is formed as an integral part of the upper end of a container body 50. It includes a central end section 52 formed on the top of body 50, which is shown as a two-piece structure, but may be an integral body if desired. Extending from the upper edge 53 of section 52 is a cylindrical neck section 55 which terminates at its upper edge in a curled seal rim 60. The rim 60 is intended to contact an elastomeric or equivalent seal, typically fitted within, or formed upon, the underside of cap panel 42. Rim 50 can function as an opening for dispensing contents of the container, and also provides a fill opening. Typically, this form of container would be used for packaging soups, various food products, etc. much as prior 'tin cans' or similar cans with removable top panels. If the canning process requires retorting of the product, the container bodies and caps can be fabricated from tin-plate steel or the like.

As in the first described type of container, extending outward from the side of upper neck section 65 is a set of horizontally elongated multiple thread lugs 75 (see FIG. 1), shown (by way of example and not limitation) as four in number. Each thread lug includes a central part 76 extending generally parallel to and at a predetermined distance below the curl rim 60, downward extending stop parts 77 and upward extending entrance parts 78. The thread lugs extend for a predetermined length partly around the neck, leaving spaces between the thread lugs for passage of the cap lugs during closing and opening. Thread lugs 75 cooperate with the inwardly extending cap lugs to hold a cap firmly on the seal rim 60. A cap is attached to the upper neck portion, and rotated causing the cooperating thread lugs 75 and cap lugs to draw the cap top panel 52 and its seal against seal rim 60.

Rotating Forming System

Figure 7:
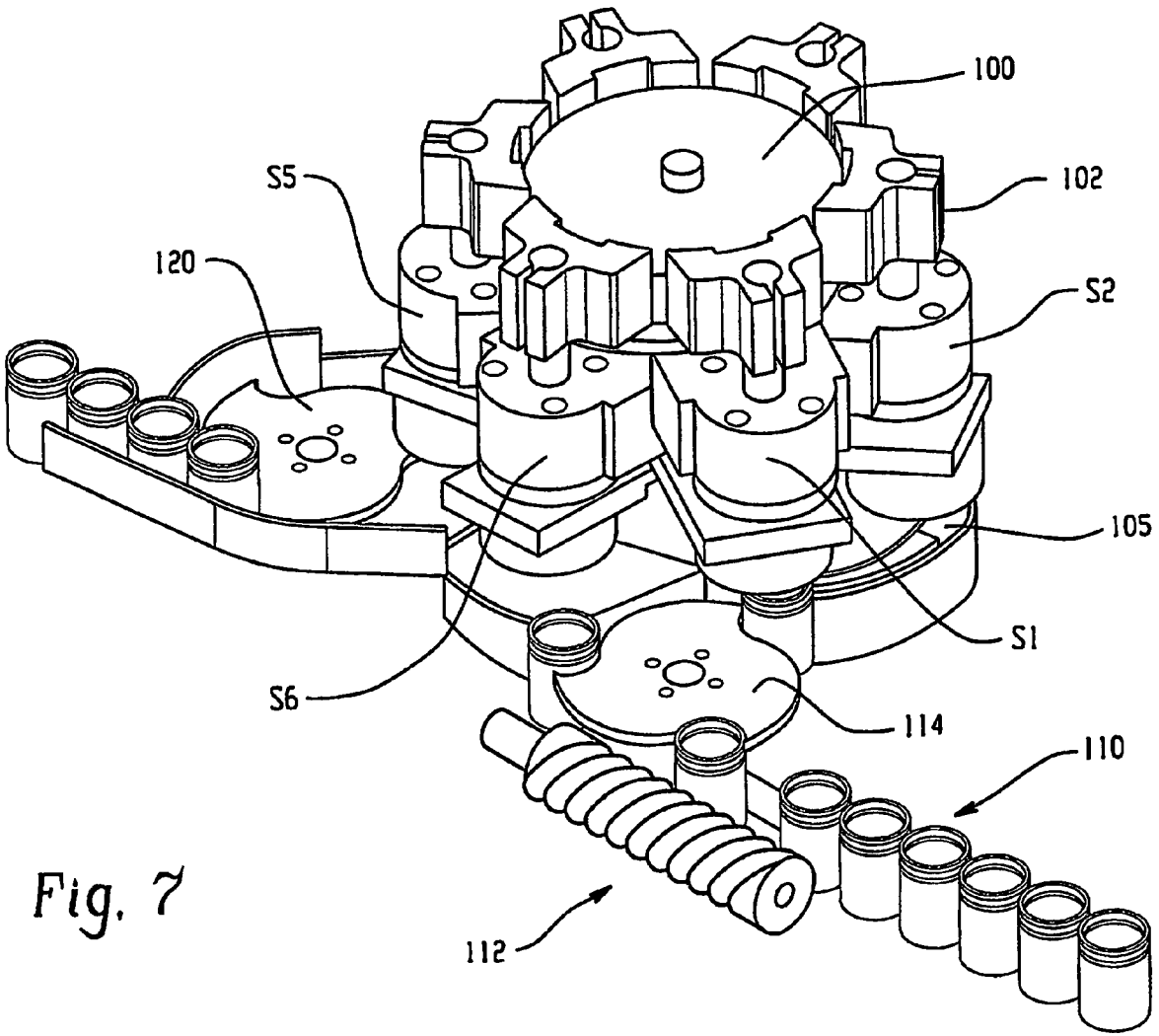
FIG. 7 is a perspective view of the overall layout of a multi-station rotary machine for forming thread lugs onto the necks of can bodies.
Figure 8:
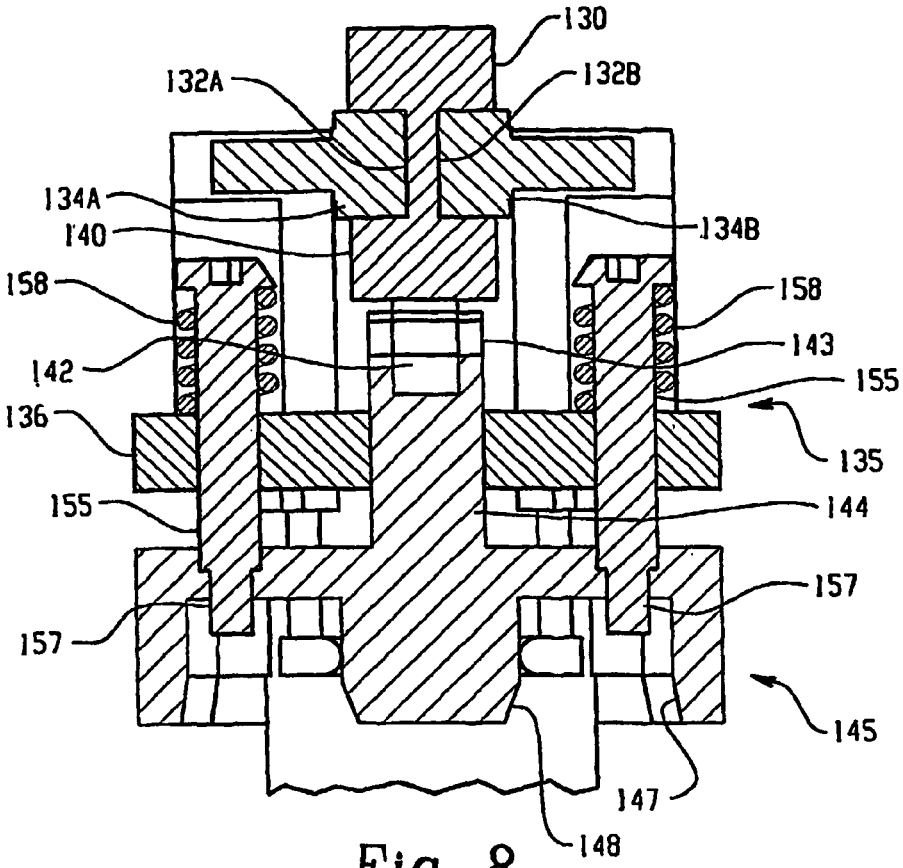
FIG. 8 is a cross-sectional view through the annular cam and the tooling associated with one the stations which pass about the cam.
Figure 9:
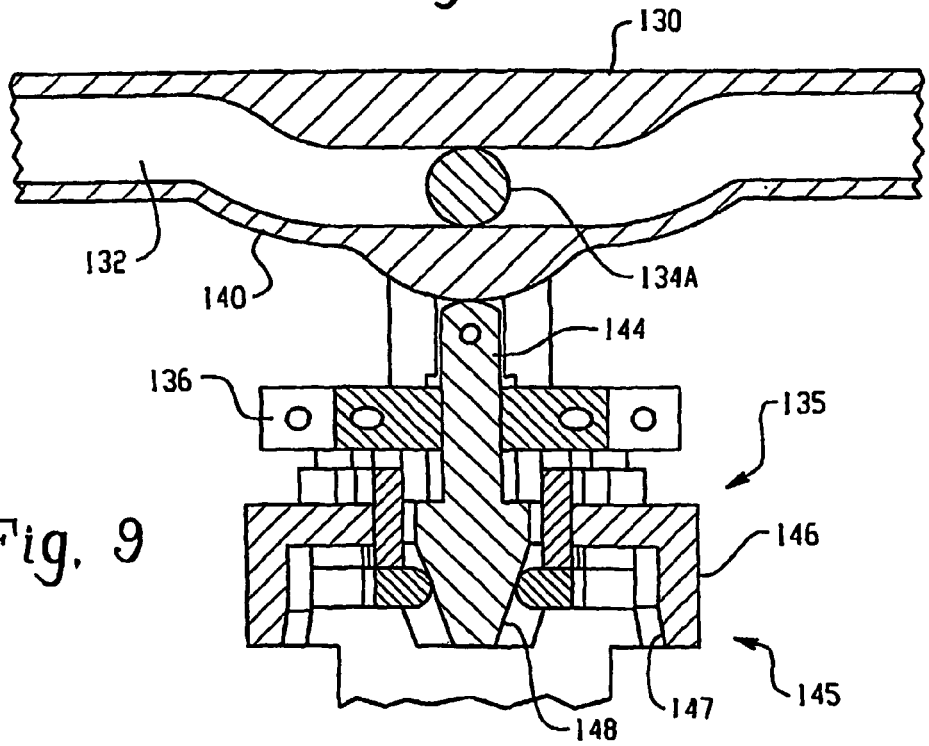
FIG. 9 is a cross-sectional view taken vertically through FIG. 8.

Referring to FIGS. 7, 8 & 9, a continuously rotating apparatus is provided for forming the thread lugs on the necks of the pre-formed container bodies. The rotating portion of the apparatus includes a plurality of stations S1-S6 supported on an upper plate 100 and each including an upper bracket 102 fixed to plate 100 and a lower stationery supporting plate or bed 105 over which the container bodies are transported, with their open tops facing upward. A row 110 of the pre-formed (necked) container bodies (in these Figures the containers 50 are shown) is supplied by a suitable conveyor (not shown) to a screw type conveyor device 112 which separates the container bodies by a predetermined distance (the distance between vertical centers of the stations) and then the container bodies are fed by a lobed loading wheel 114 into successive empty stations wherein the containers bodies are moved up a short ramp 115 into the open tooling of the respective stations S as they pass the loading wheel 114. After the thread lugs are formed on the container necks, the containers are discharged from the apparatus by a lobed unloading wheel 120, and exit the apparatus in a line, as shown.

Referring to FIGS. 9, and 11-14, a stationary double cam ring 130 is supported beneath upper bracket 102. FIG. 9 illustrates the general configuration of the cams in a plane, rather than circular, for ease of understanding. The first cam 132 is in the form of complementary inner and outer slots 132A and 132B machine into the radially inward and radially outward surfaces of ring 130. A pair of roller followers 134A and 134B fit within slots 132A and 132B and are attached to a depending die and punch support and actuating mechanism 135 (FIGS. 8, 9 & 10) which has a central body 136 which is attached beneath cam 132 and has transverse slots 137 that provide support and guidance to pairs of pivot arms 138, which are suspended at their upper ends on pins 139 within slots 137 Return springs 138A extend between the pivot arms 138 to urge them to their retracted locations (see FIG. 10). As the followers 134A and 134B enter the downward curved portions of slots 132A and 132B, body 136 and arms 138 begin to descend (see FIGS. 11 & 12).

Body 136 also has a second cam 140 formed on its undersurface, and a roller follower 142 follows this second cam. Follower 142 is supported on a pin 143 at the upper end of a central shaft 144 which is supported to slide vertically in body 136. At the lower end of shaft is a punch and die actuator 145. Actuator 145 has an outward extending inverted cup shape 136 with an annular cam surface 147 and an inner central cam surface 148, which control the motion of the outer form die tools 150 and inner punch die tools 152 (respectively). As previously noted, there is a set of punch and die tools for each of the thread lugs to be formed about a container neck, usually three or four lugs.

Guide and control rods 155, with enlarged heads 156, extend downward through body 136 and have threaded tips 157 attached to the actuator cup 136. Springs 158 urge the rods 155 upward, thus pressing cam follower 142 against cam 140. In open position, pivot arms 138 are urged apart (as shown in FIG. 10) by suitable springs, not shown.

Figure 10:
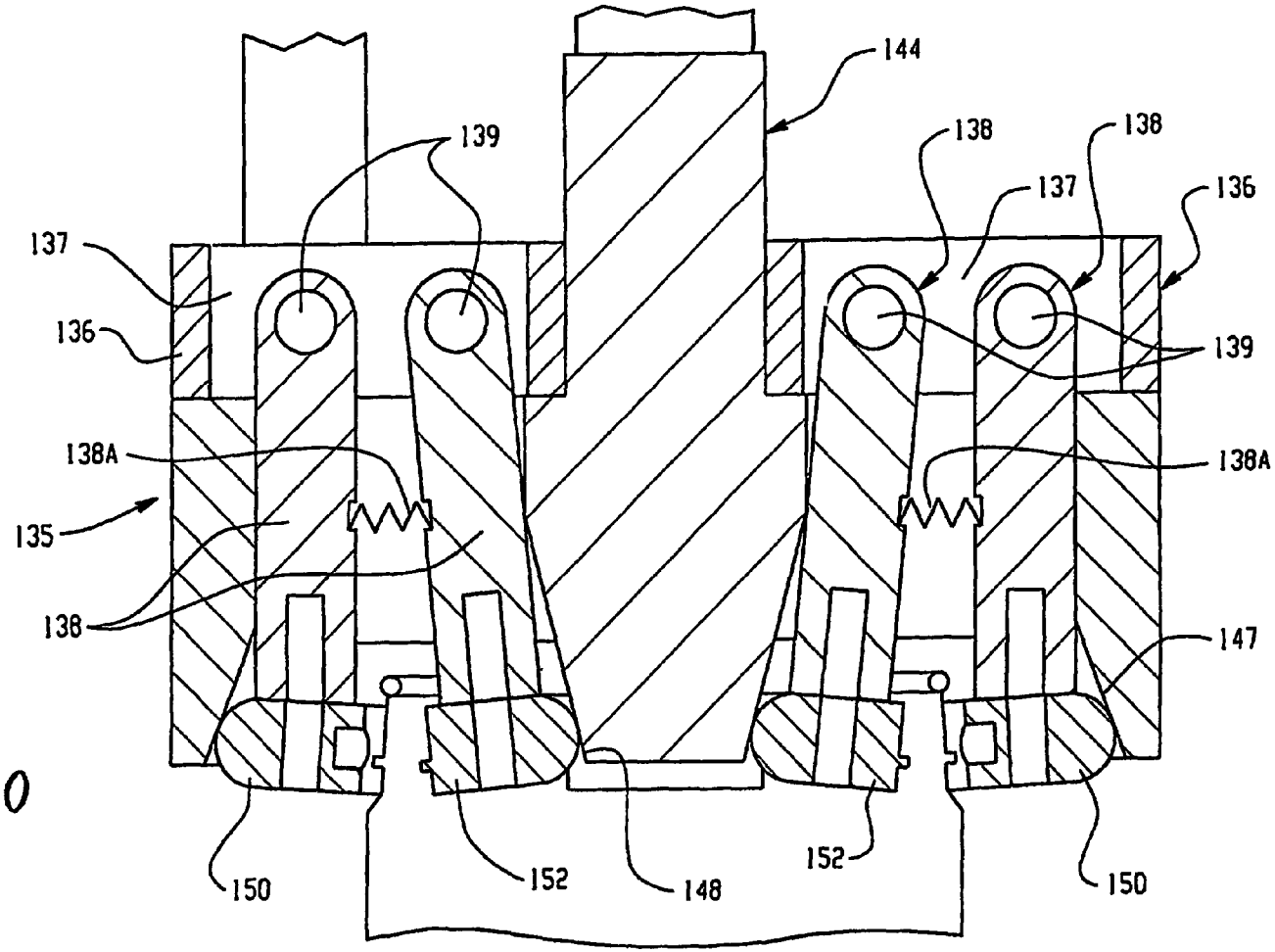
FIG. 10 is an enlarged cross-sectional view showing details of the punch and die tools for one station with the upper end of a can body positioned within the tools.
Figure 12:
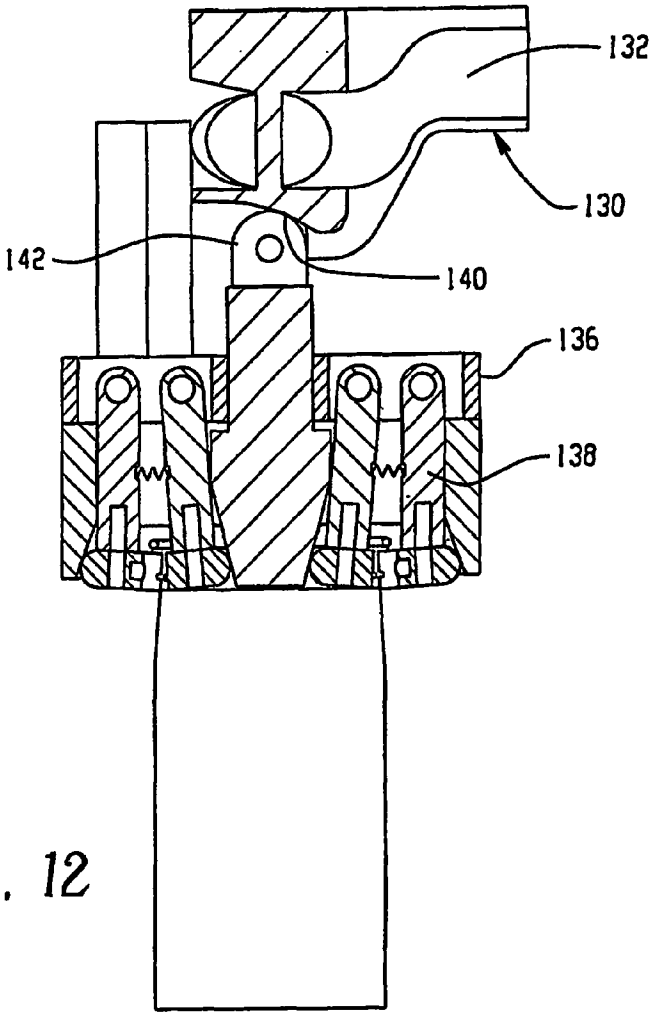
FIGS. 11-14 are progressive views, on a smaller scale, illustrating the interaction of the cam followers of the tooling and the resultant thread lug forming action of one set of the punch and die tools.
Figure 11:
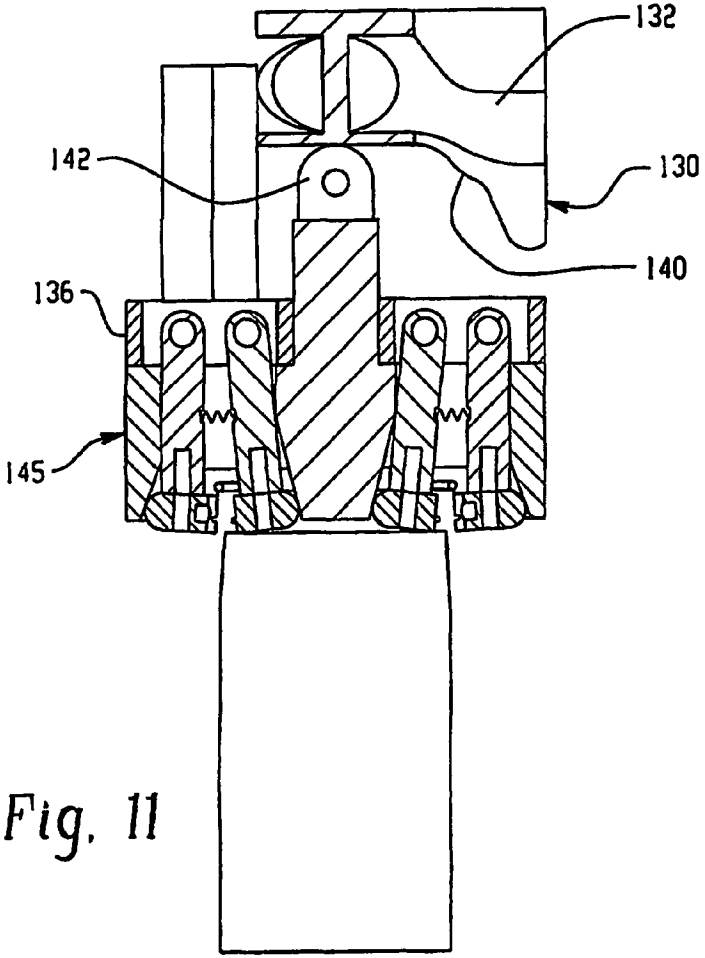
Figure 14:
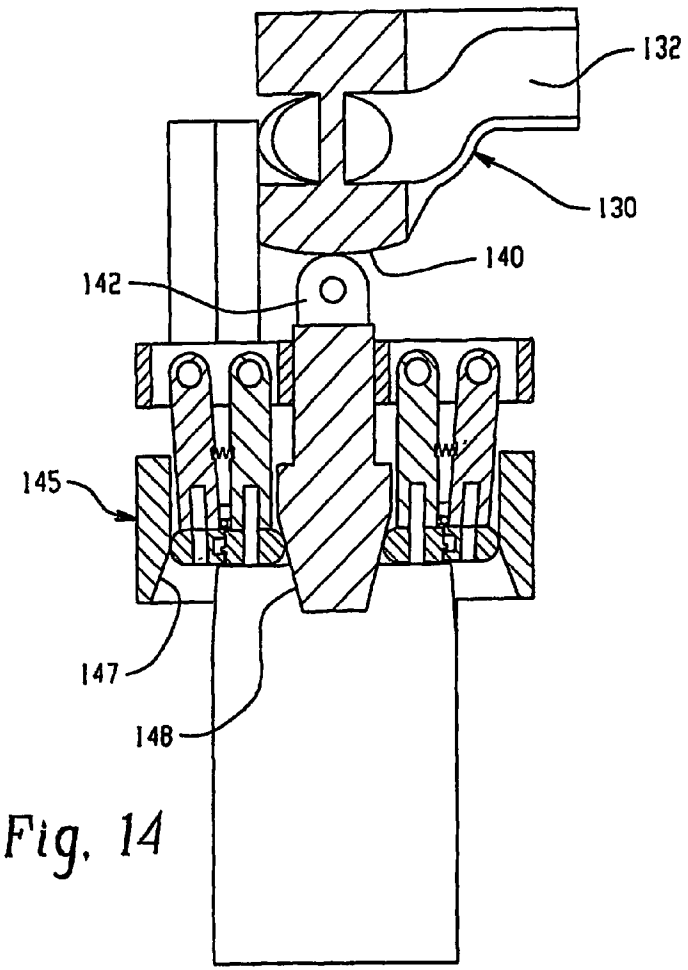
Figure 13:
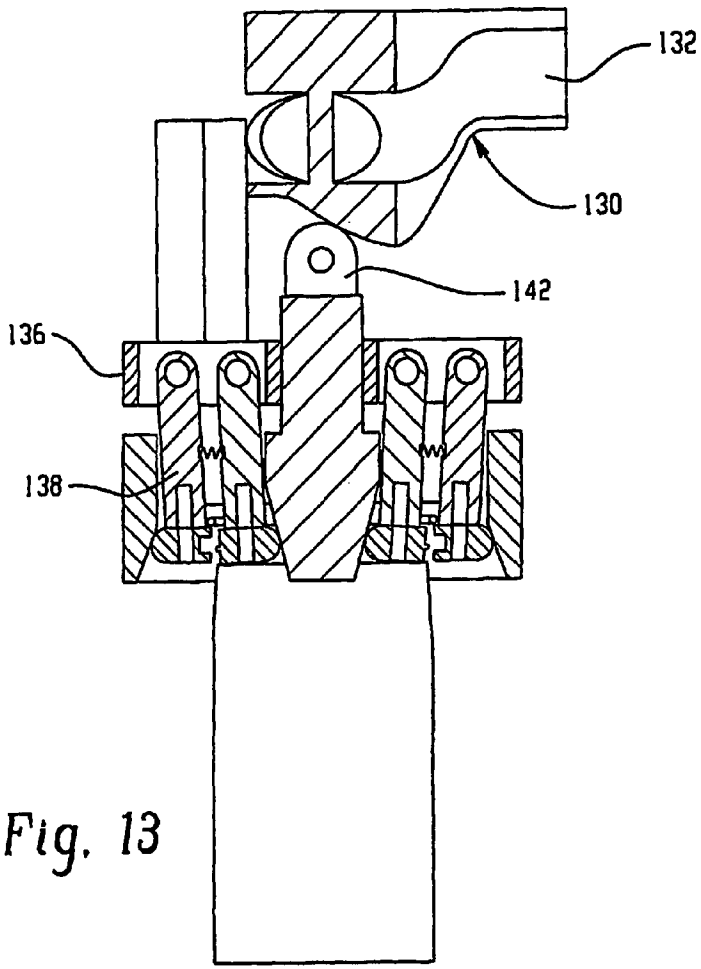
Figure 16:
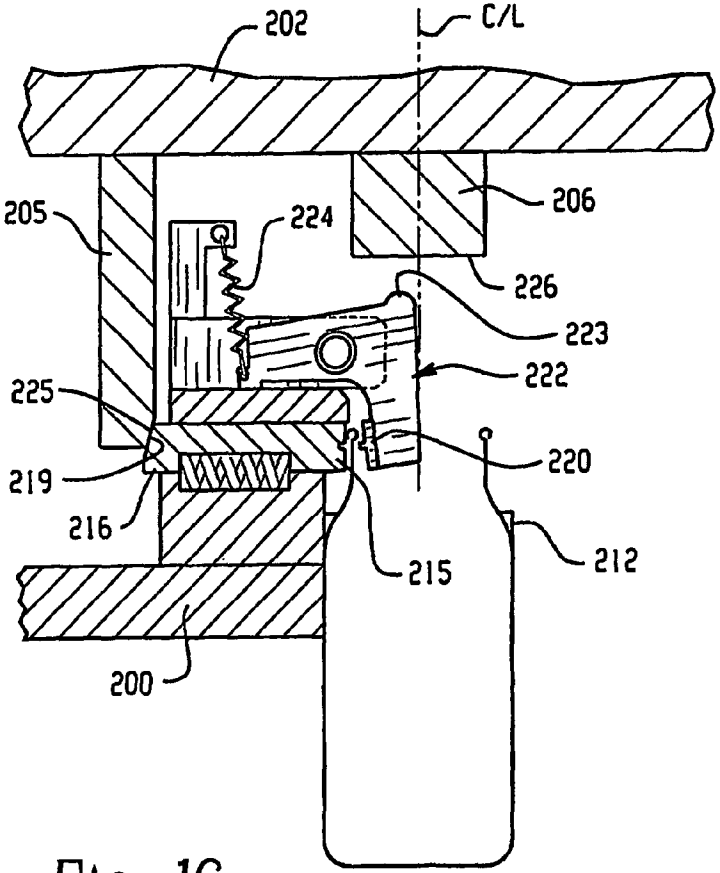
FIGS. 15-18 are progressive views of another embodiment of punch and die tools which are adaptable to a reciprocating machine for forming thread lugs onto the necks of can bodies.
Figure 15:
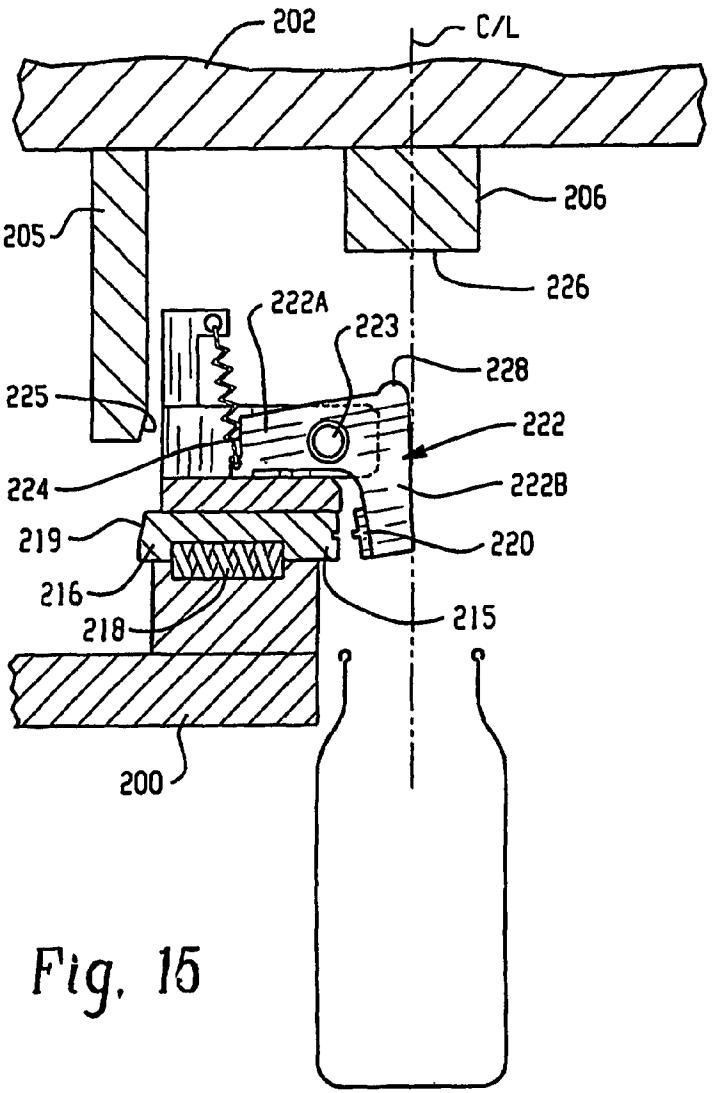
Figure 18:
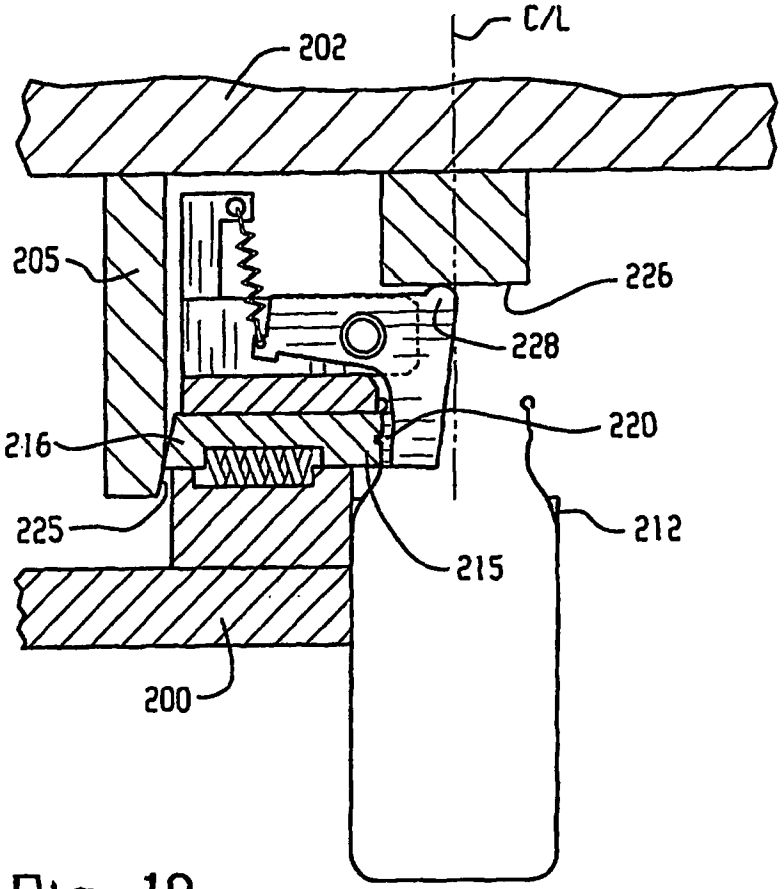
Figure 17:
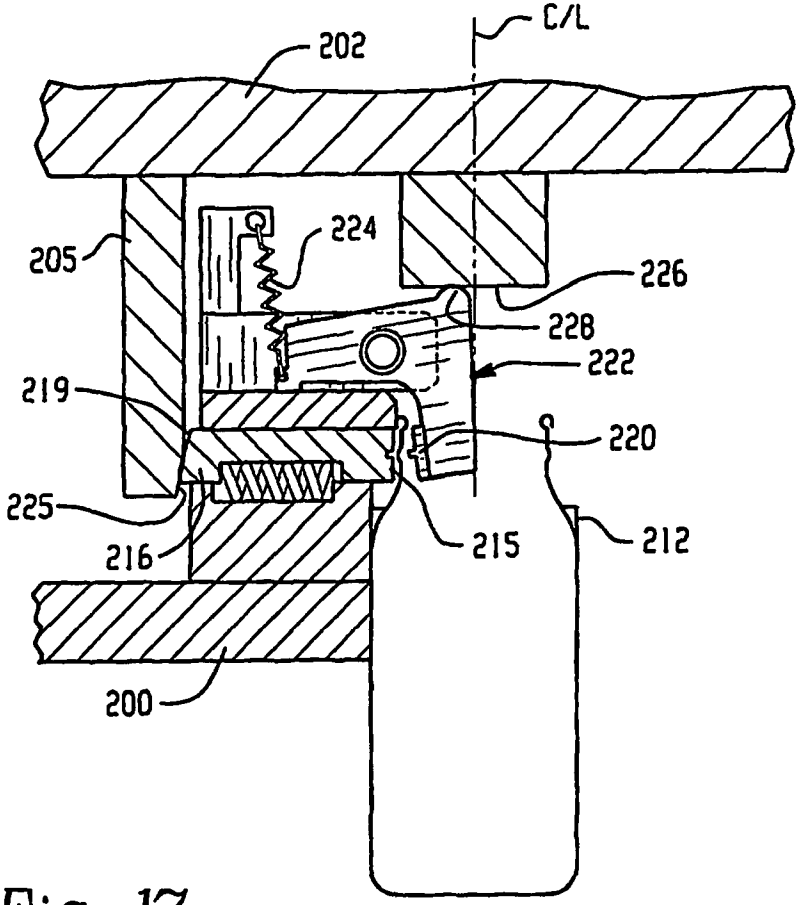

As each station S1-S6 is moved around the cam ring 130, followers 134A and 134B follow the slope of slots 132A, 132B and move the associated actuator mechanisms downward, positioning the punch and die tools 152 and 150 around, and spaced from, the container neck (FIGS. 10 & 11). Next, follower 142 moves the actuator 145 further downward (FIG. 12). Cam surface 147 causes the die tools to swing inward and to engage the outer portion of the container neck (FIG. 13). The central cam surface 148 then causes the punch tools to swing outward against the interior of the container neck (FIG. 14), to impress the thread lugs into the neck.

Further movement of the station about cam ring 130 causes this action to reverse. The form punch tools 152 and form die tools 150 separate, the actuating mechanism 135 is raised above the container end, and the container is discharged.

It will appreciated by those skilled in the art that the shape of cams 13 and 140 can be varied to achieve a desired closing and opening motion, and closed dwell time, of the form dies and form punches.

Reciprocating Forming System

Figure 19:
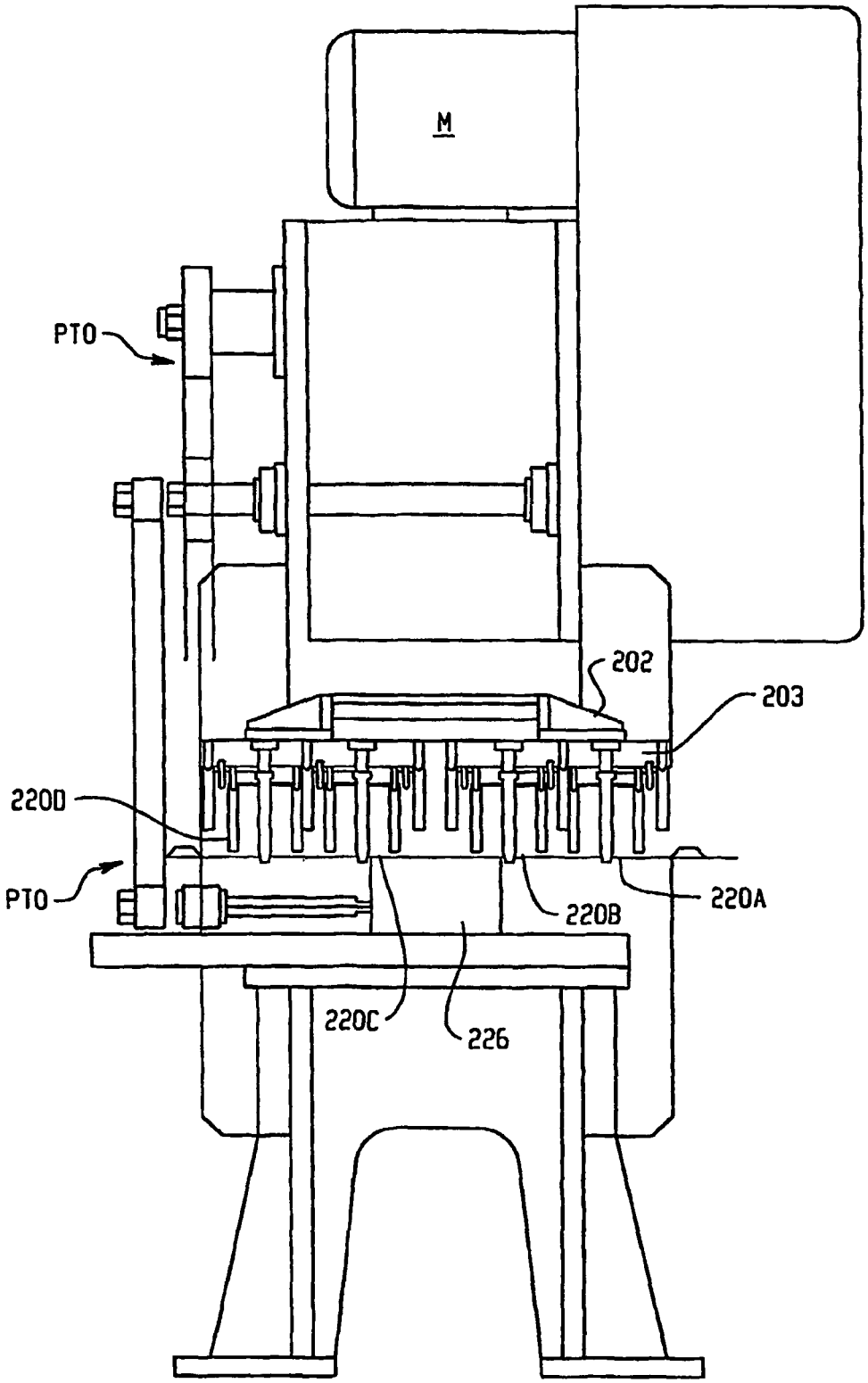
FIG. 19 is a front view of a reciprocating press system utilizing tools similar to those illustrated in FIGS. 8-10.
Figure 20B:
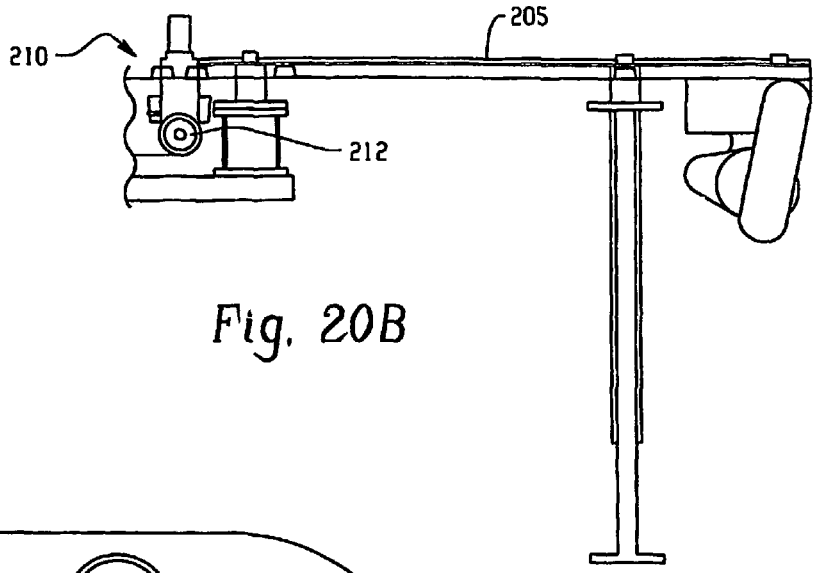
FIG. 20A and 20B, together, comprise a side view of the press system shown in FIG. 19.
Figure 20A:
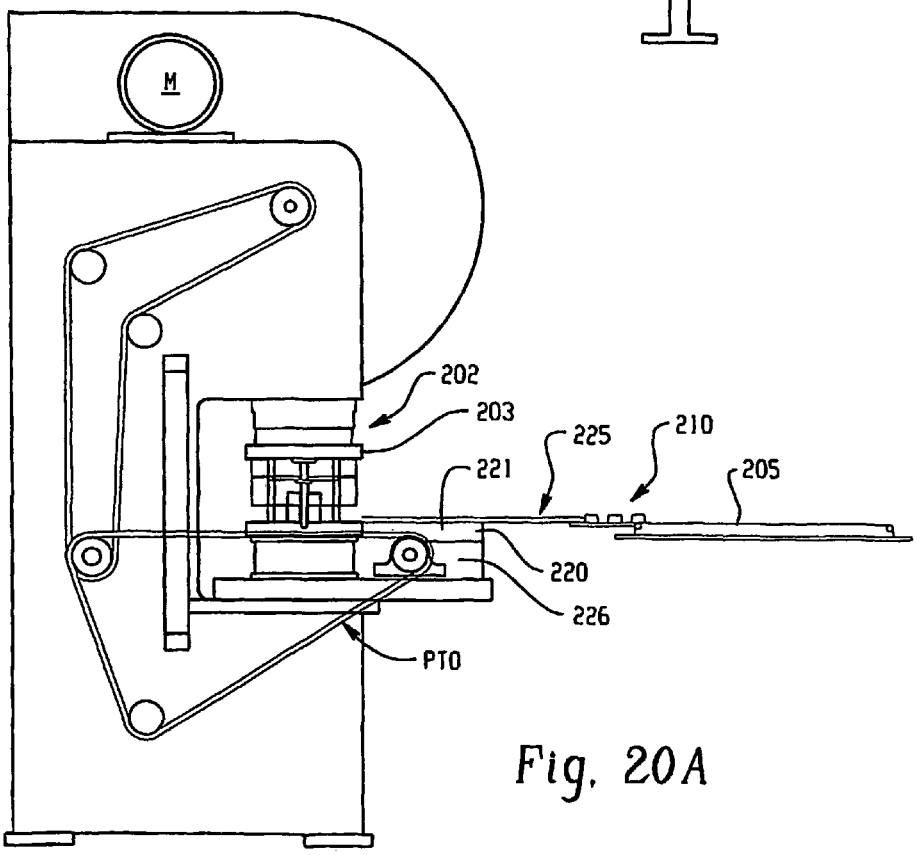
Figure 21:
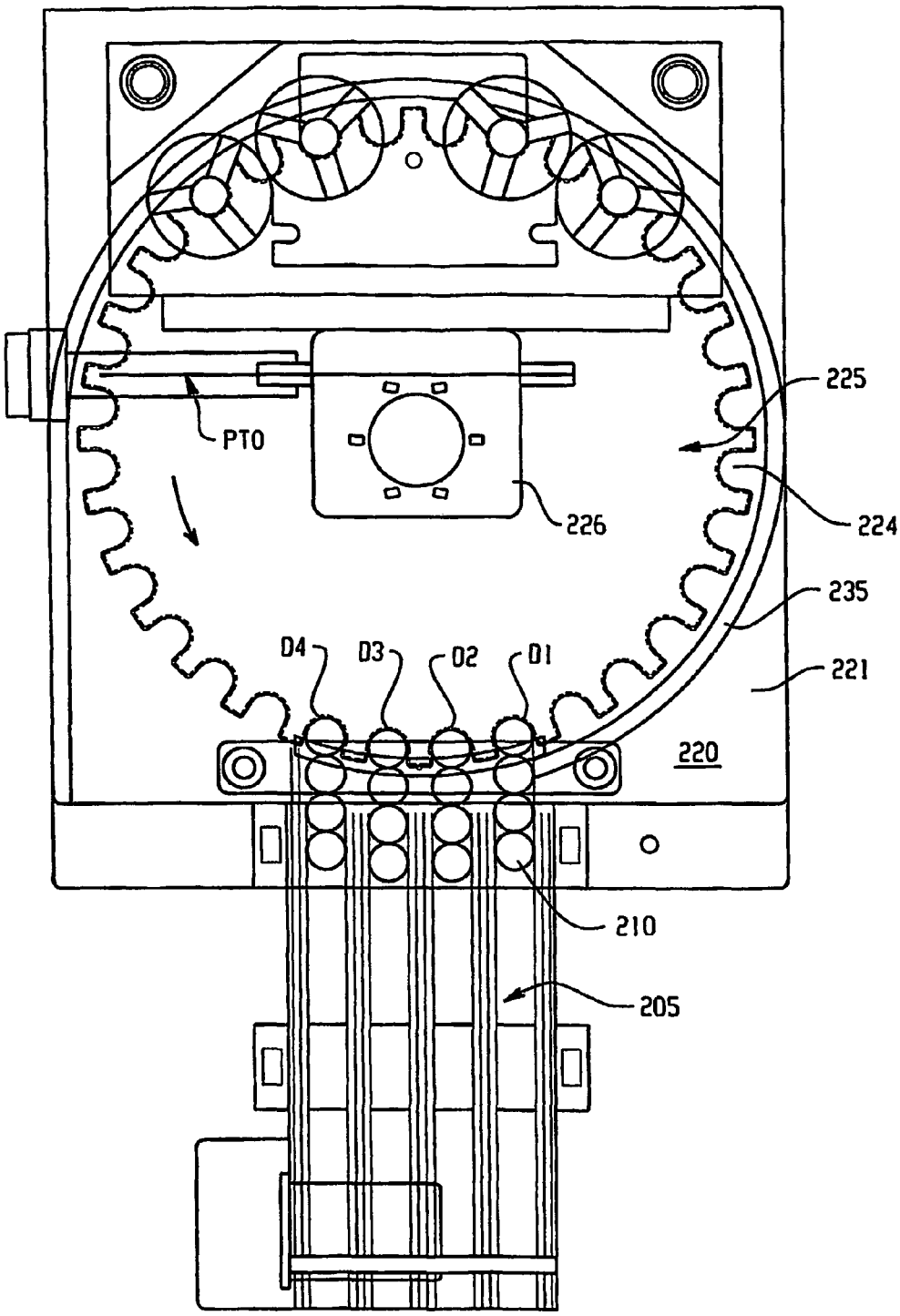
FIG. 21 is a top view showing the press and the indexing feed wheel which carries parts to the press tool stations, along with related conveying equipment.
Figure 22:
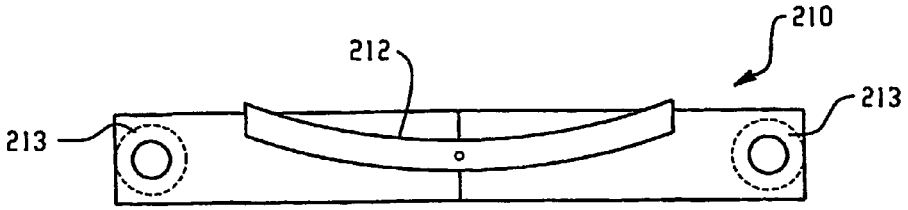
FIG. 22 is an enlarged partial view of the separator bar associated with the escapement mechanism.
Figure 23:
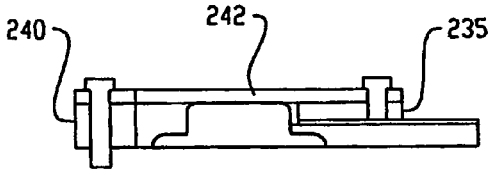
FIG. 23 is an enlarged detail view of the part discharge from the system.

Referring to FIGS. 19-21, another embodiment of this invention provides tooling and mechanisms for the thread lug forming method in a reciprocating apparatus (as distinguished from rotary) using a reciprocating press that includes a bed plate 200 supported on a bolster (not shown), and a reciprocating ram 202 which is driven by motor M through a conventional crank and connecting rod drive (not shown). A press of 55 Ton capacity, rated at 100-150 strokes/minute, having a 7.5 HP drive motor, may be utilized in this system. The press is also fitted with a power take-off PTO which supplies power to an attached indexing drive for operating the in-feed indexing wheel mechanism and an associated escapement mechanism in proper timing with the ram reciprocation. As will be apparent from the following description, this system may be designed to form thread lugs on the necks of parts (e.g. container domes) previously manufactured, or to form thread lugs on the necks of containers, particularly one-piece containers having an integral bottom, side, and a neck formed on the top of the sides.

FIGS. 15-18, illustrate generally four like tooling stations including parts (see below) attached to an upper tool base 203, which is in turn fitted to the under surface of ram 202. Container dome parts D1, D2, D3, D4 (see also FIG. 1-A), on which a neck D-25 with a curled dispensing opening D-30 and a lower peripheral wing part D-21 have already been formed, (see U.S. Pat. No. 6,015,062) are supplied by a conveyor belt 205 in multiple side-by-side rows (FIGS. 21 & 26) to an escapement mechanism 210, which includes a curved vertically moveable gate 212. Gate 212 is urged toward a lower position by a pair of springs 214, and is raised by a lobed cam 215 (FIG. 27) which is rotated by the PTO in synchronism with the reciprocation of press ram 202. In its lower position gate 212 rests in front of the necks of the foremost dome parts at the exit of conveyor 205 and is raised (FIG. 26) against the pressure of springs 216. Those springs urge gate 212 to its lowered position, where the gate extends between the neck of dome parts in successive rows (FIGS. 21, 22, 26 & 27). The gate is raised for a short time to allow those four dome parts to pass through the escapement mechanism 210. Those four parts proceed onto a horizontal platform or plate 220 which is mounted on the press bolster. Plate 220 extends forward out of the press mouth, and has a non-abrasive, relatively low friction, upper surface 221 which may be provided by using stainless steel, or a chrome finish on surface 221, or a plurality of low friction inserts.222 in the areas of the upper surface over which the domes and/or containers slide. One of the functions of plate 220 and its upper surface is to provide a stable and uniform base for the dome parts or container bodies as they are fed into and moved out of the thread lug forming stations.

In the embodiment illustrated there are four thread lug forming stations, 220A, 220B, 220C & 220 D which form sets of thread lugs onto the necks of dome parts or container bodies during each press stroke. Thus, a plurality of container dome parts (or containers) are conveyed in multiple rows, (the illustrated embodiment has four rows) with their bottoms at the level of plate upper surface 221. The foremost row is passed through escapement mechanism 210 when its gate 212 is raised by lobed cam 215 (see above), and moved into peripheral pockets 224 in a step-wise driven feed wheel mechanism 225, which is driven by an indexing mechanism 226 (FIGS. 19, 20, 21 & 25) powered by the PTO. The indexing mechanism is a well know commercially available unit, sometimes known as an 'intermitter."

Figure 1A:
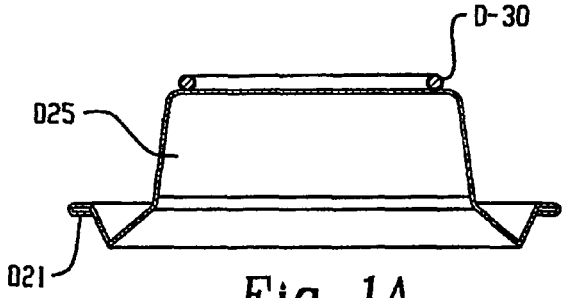
Fig. 1A PRIOR ART
FIG. 1A (Prior Art) is a view of a separate dome structure.
Figure 24:
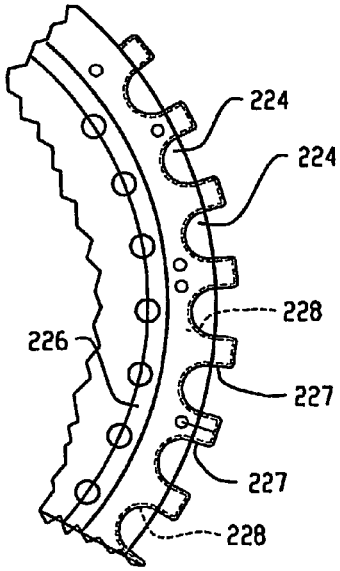
FIG. 24 is an enlarged detail view of four adjacent ones of the pockets in the feed wheel periphery.
Figure 28:
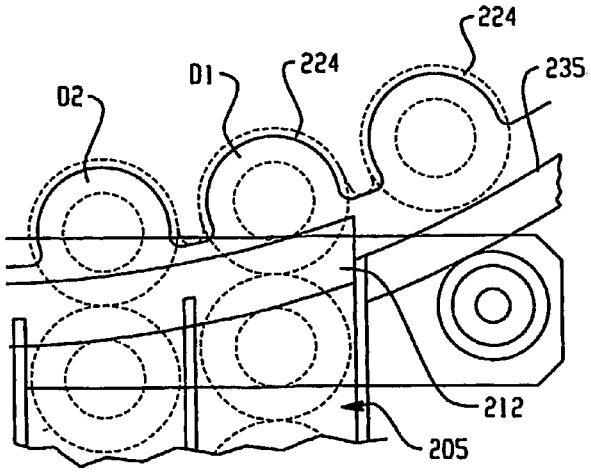
FIG. 28 is an enlarged fragmental with of the intersection of the outer ail and the escapement mechanism.
Figure 25:
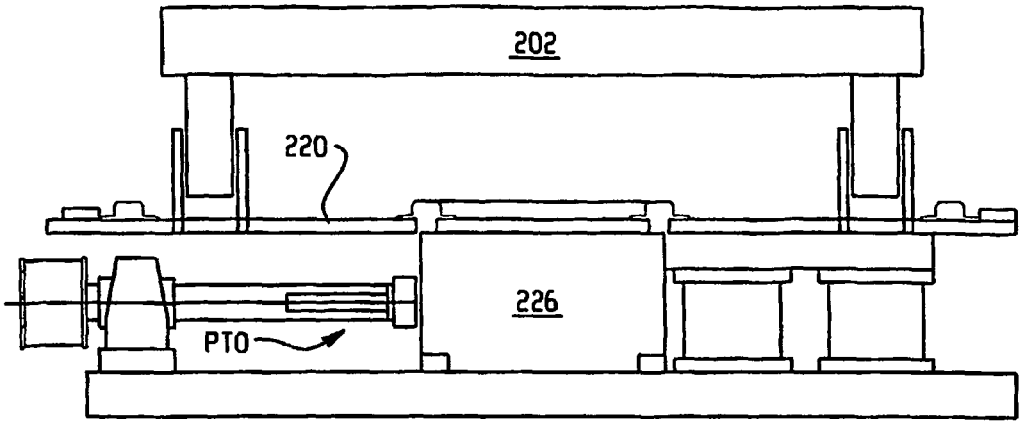
FIG. 25 is a partial vertical cross-section view from the front of the system, showing the press ram, the feed wheel and its drive, and omitting the press stations and associated tooling.
Figure 26:
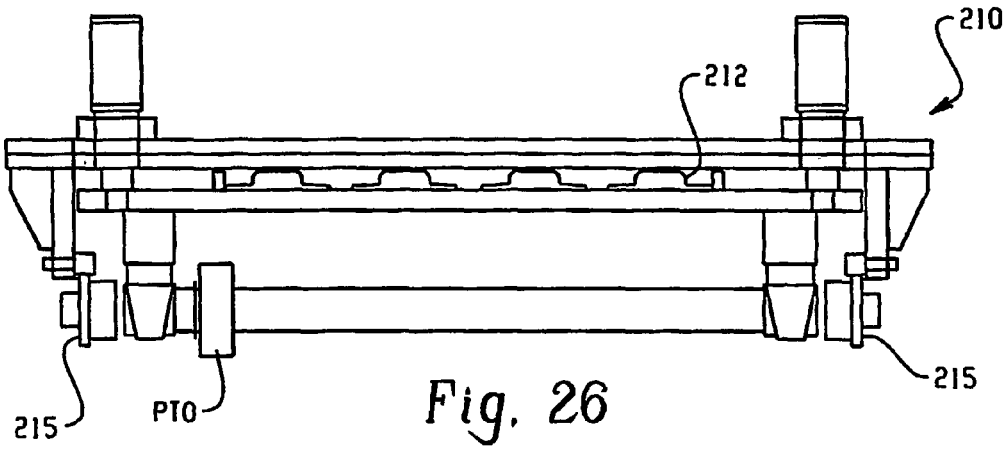
FIG. 26 is frontal view of the escapement mechanism and its drive with a segment of the in-feed conveyor.
Figure 27:
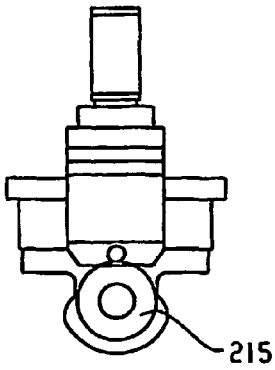
FIG. 27 is a view taken from the left side of FIG. 26.
Figure 29:
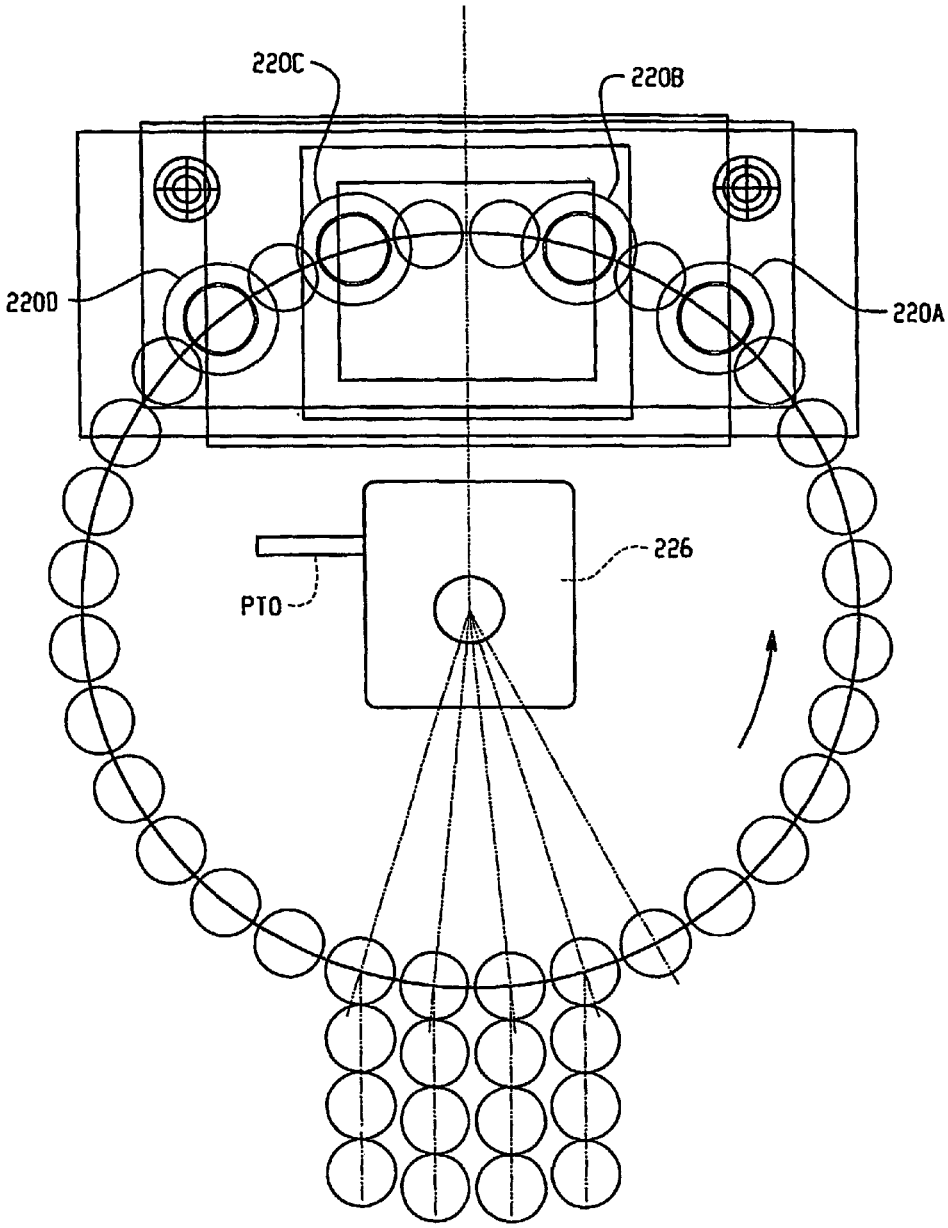
FIG. 29 is a schematic view of the feed wheel, receiving parts from the in-feed conveyor system and passing horizontally through the tool stations, and illustrating the indexed motion of the feed wheel and distribution of parts or containers to the multiple thread lug forming stations.
Figure 30:
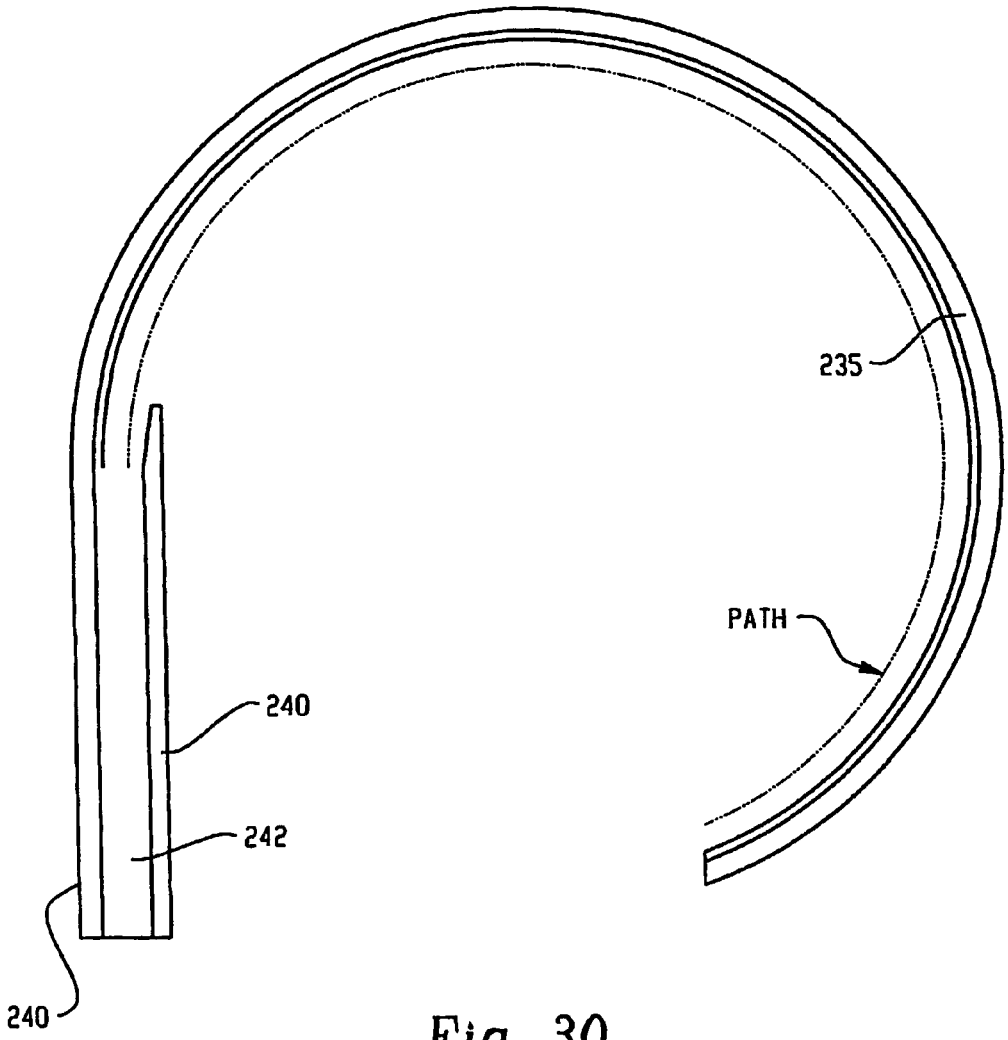
FIG. 30 is a plan view of the rail members partially surrounding the feed wheel.

In this embodiment there are eight sets of four such pockets about the periphery of the feed wheel mechanism 225, and one index of the wheel mechanism is equal to the arcuate length of four pockets (one set) or 45°. Preferably the pocket sets are formed of Nylon or similar polymeric material, and are bolted in precise alignment to the wheel disc 226, as shown in FIGS. 21 & 24. The pockets 224 have a generally U-shaped outer end or fork 227 with a chamfered under surface 228 which is dimensioned to fit about the lower portion of the necks of the domes, closely above the dome wing sections D-27, as shown in phantom in FIG. 1A. Thus the pockets closely embrace the lower end of necks on the parts, or necked container bodies (FIG. 42) and move them in predetermine increments by wheel mechanism 225. The wheel mechanism is rotated step-wise each time the press is opened during operation.

The parts or container bodies are pushed about the inside of a stationary arcuate guide rail 235 (see FIG. 21) which extends from the in-feed conveyor (i.e. the loading station) past the last thread lug forming station, over an arc of about 260°, defining the exterior of a curved path of the step-wise moving parts or bodies. The aforementioned low friction inserts (if used) will be arranged around the inside radius of rail 235 and their radial width will be slightly larger than the diameter of the dome parts or container bottoms. Thus the lower faces of the parts or container bodies move with little resistance over the surface of plate 220 and are not disturbed (e.g. tipped) as the indexed motion proceeds. The outer edge of the dome parts, or the exterior of the container bodies, are guided along the inside edge of rail 235 as they proceed through the thread lug forming stations to the discharge from the system. The forks 227 are sufficiently low, in passing through the thread lug forming stations 220A-220D, that the thread lug forming tools operate on the upstanding necks without interference, as described below The sequence of feeding the dome parts (or container bodies) is such that each of the four parts fed into the wheel mechanism reaches at thread lug forming station associated with its place in the row as loaded. For example, referring to FIG. 21, part D1 remains in the pocket into which it was loaded through four indexes of the wheel, at which time the part D1 is located at station 220B. Similarly after five indexes part D2 is in station 220D after five indexes; after three indexes part D3 is in station 220A; and after four indexes part D4 is in station 220C. At the end of rail 235 there are forwardly extending higher rails 240, extending above the top of the finished necked parts or container bodies (FIG. 21) with a detachable cover 242, providing a discharge passage to the front of plate 220 which can be directed to a suitable collection point or device (not shown).

Figure 31:
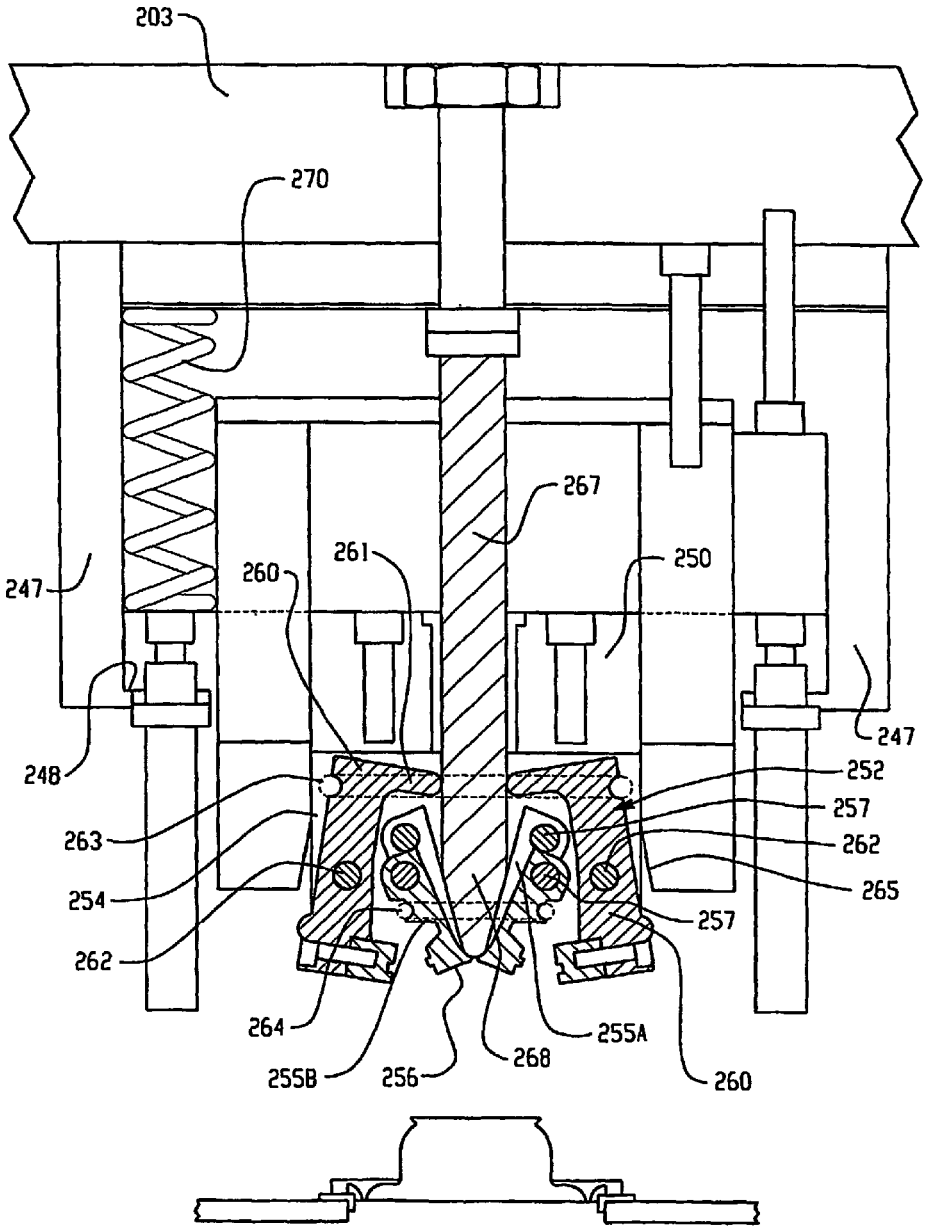
FIG. 31 is a partial cross-section view on a larger scale taken vertically through one of the press tool stations with its tools in fully raised position.
Figure 32:
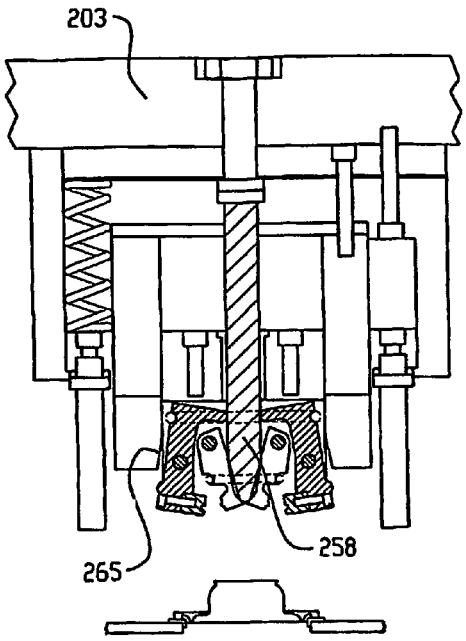
FIGS. 32 and 33 are views similar to FIG. 31, on a smaller scale, taken at right angles to each other to show the different hinge axes of shorter and longer thread punch levers.
Figure 33:
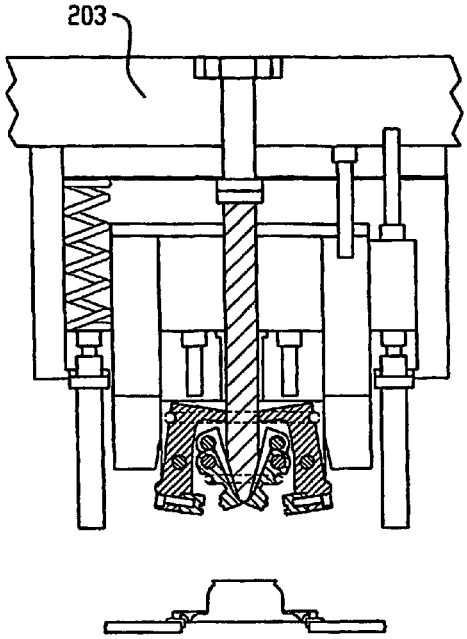
Figure 35:
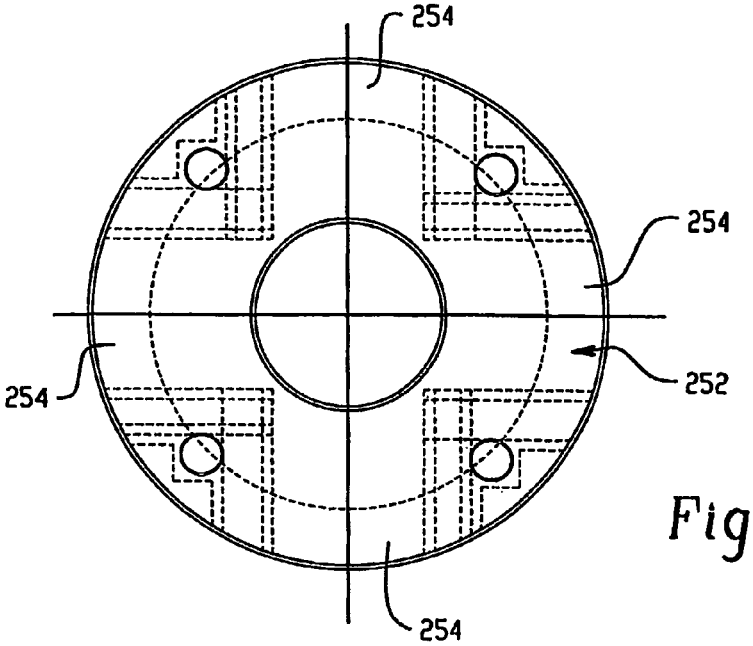
FIG. 35 is a top view of the tool carrier shown in FIG. 31
Figure 37:
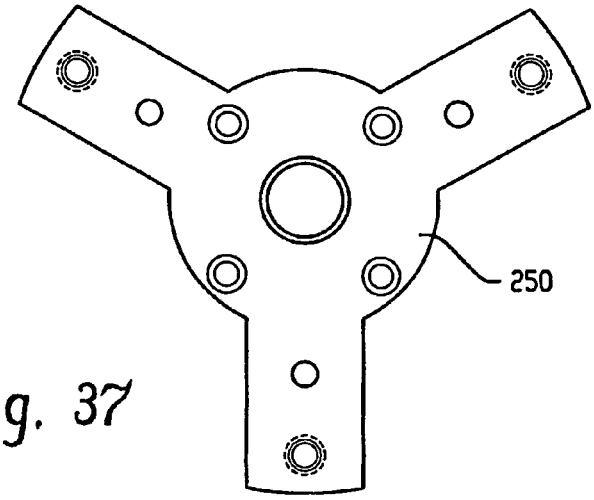
FIG. 37 is a top view, on a reduced scale, of the Y-shaped support from which the tool carrier is suspended.
Figure 36:
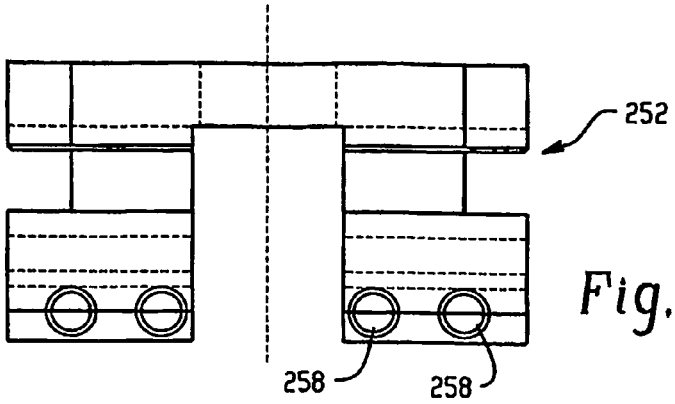
FIG. 36 is a side view of the tool carrier.

Referring to FIG. 31, the plate 203 at the top is the top member of the 'die set' (to be fixed to the press ram) from which all the tooling for each of the thread lug forming stations 220A-D is suspended. A plurality of vertically descending keeper bars 247, bolted to plate 203, are each provided with a lower lip 248. A Y-shaped 'spider' like member 250 (see FIG. 37) is vertically moveable (and captured) within keeper bars 247, and a tool carrier 252 is bolted to the underside of the member 250. There are four vertical slots 254 in carrier 252 (FIGS. 35 & 36) and within those slots are a plurality of horizontally pivoting inner or "punch" arms 255 (long arms 255A and shorter arms 255B; see FIGS. 38 & 40) which are supported on pins 257 fitted within bushings 258, at the correct height within tool carrier 252. The shorter and longer inner arms alternate around the carrier and are employed to allow better clearance for their respective pivot pins. Also contained in slots 254 are four horizontally pivoting outer "die" arms 260 which are supported on pins 262 fitted with bushings 263. Each of the arms carry a thread lug forming tool (as later explained).

Die springs 270 act between the spider-like member 250 and plate 203 to urge the entire tool assembly onto the keeper bar lips 248, into retracted position as seen in FIG. 31. Garter springs 263 and 264 extend around the inner and outer arms 255, 260 to urge them into their open position (see FIG. 34). Tool carrier 252 slide has a slanted cam formation (inverted partial cone) 265 at its lower end for interacting with the outer arms 260 (see FIG. 34). In the center of the tooling is a vertically extending probe-like rod 267 with a cam formation 268 on its lower tip which will pass through the inner tool arms 255 to swing them outward as the press closes and the tools move into engagement with a neck, as shown. The outer arms 260 have a stop arm 261 which, when cam 265 is withdrawn upward, defines the extent of open motion of the arm, and thus of the thread lug die. The inner arms 255 have small pads 256 on the back of their lower tips which come together under bias of the garter spring 263 when the rod 267 is withdrawn as shown in FIG. 31.

Figure 34:
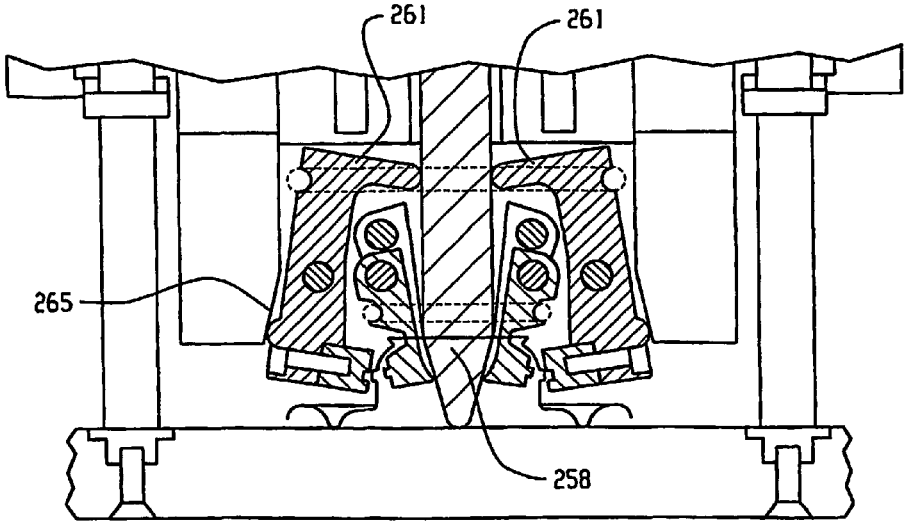
FIG. 34 is a view similar to FIG. 31, on a smaller scale, showing the thread lug punch and die tools in proximity to a dome neck, after having formed thread lugs in the neck.
Figure 38:
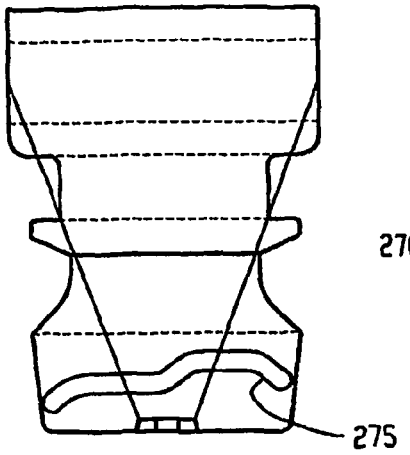
FIG. 38 is a front view of one of the short thread tool arms which is pivotally mounted in the tool carrier.
Figure 38A:
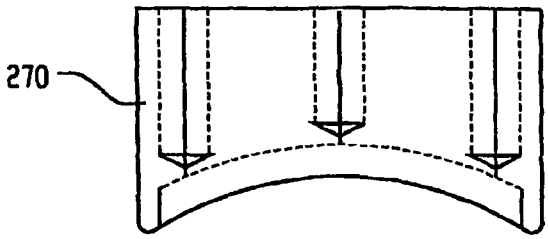
FIG. 38A is a top view of the tool attached to the arm.
Figure 39:
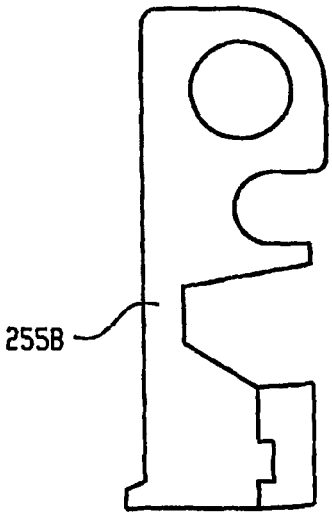
FIG. 39 is a side view of the short thread tool arm, with one of the inner (or punch) tools mounted thereon.

Thus at each thread lug forming closing operation of the tooling, motion of the tooling actuators moves the associated actuator arms 255, 260 downward and inward (FIGS. 31 & 34), positioning the punch and die tools 270 and 275 around, and spaced from, the container neck (FIG. 34). FIG. 38A is a top view of the punch tool 270 showing the curvature of the tool face, and the threaded mounting socket along with the alignment pin sockets therein. Essentially simultaneously, cam surface 265 causes the thread lug die tools 275 to swing inward and engage the outer surface of the container neck and the thread lug punch cam surface 288 causes the punch tools to swing outward against the interior of the container neck (FIG. 18), to form the thread lugs into the neck.

Figure 40:
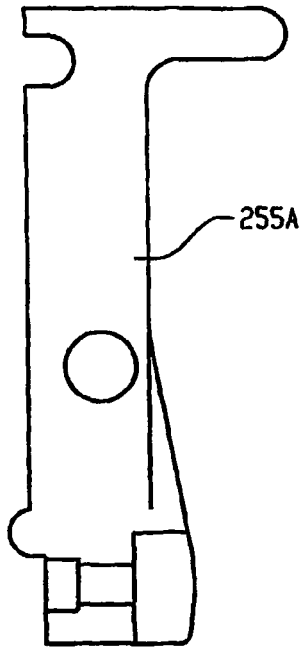
FIG. 40 is side view of one of the outer tool arms which are pivotally mounted in the tool carrier.
Figure 41:
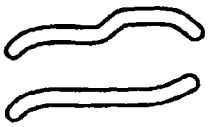
FIG. 41 is a plan view of different tool faces which interact with the necks of a dome neck and/or a neck of a container.

Referring to FIG. 41, two different punch and die profiles are illustrated. These are a part of the disclosure of published International Application PCT/US 03/20283, identified in the Background section of this application. The profiles, of course, represent the punch (profile (protruding) and the die (relieved) which together are designed to form the thread lugs on the necks. Referring to FIGS. 38 and 40, the punch tool 275 is shown attached to the lower end, outward facing of an arm 255. The shape of the punch is according to profile A illustrated in FIG. 40. These would be provided in two adjacent ones of the tool actuating arms 255 & 260 (e.g. at 0° and 90°) while the other two arms would have the profile B at 180° and 270°. In other instances where this feature is not required, profile B would be used on all punches and dies.

Figure 42:
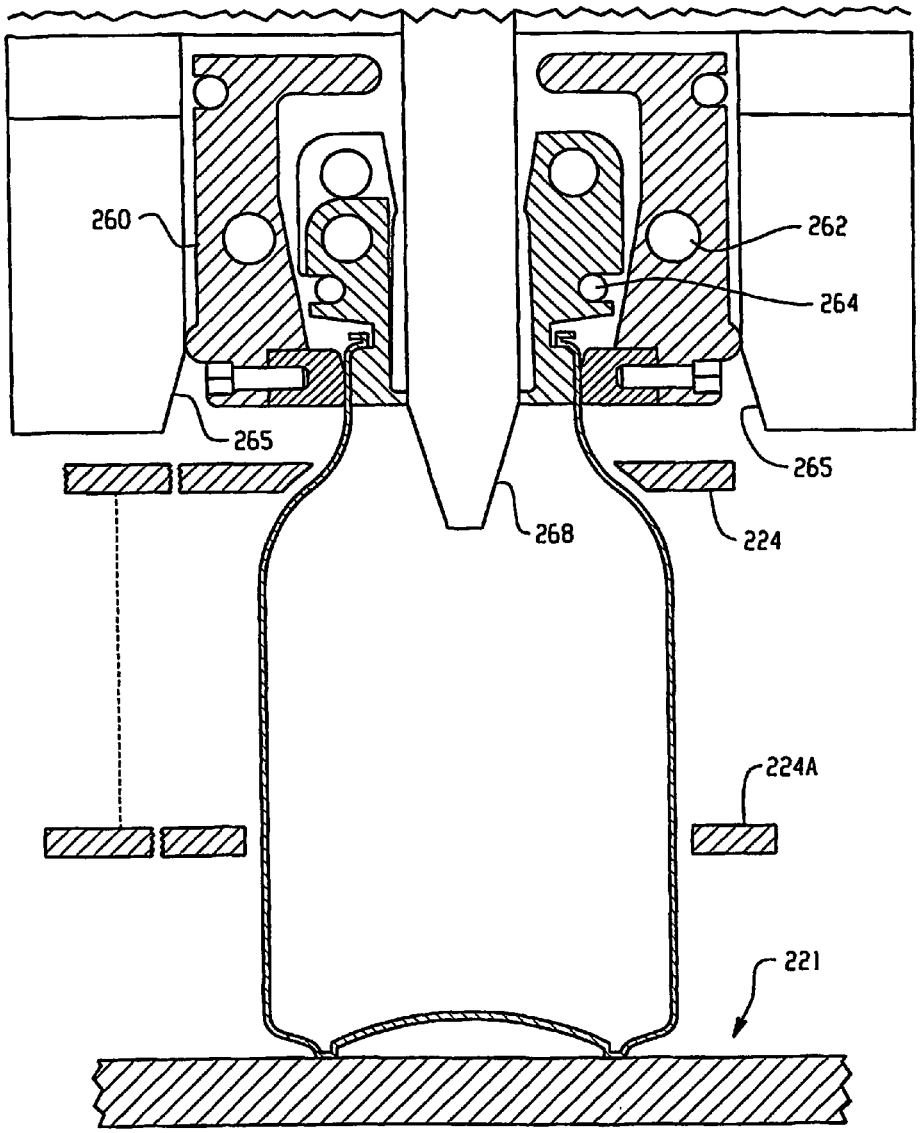
FIG. 42 is a partial cross-section view, similar to FIG. 31, showing a modification of the feed mechanism and thread lug forming stations to accommodate necked container bodies.

FIG. 42 illustrates the modification of the reciprocating apparatus to form thread lugs onto the neck of a container body which is supplied to the operation with a neck formed on the container's upper end, and a curl formed about its pour opening. The container body, as can be seen, may be unitary or multi-piece; either will fit this system. The inner and out tools are shown closed about the container neck, using the same outer and inner arms and fitted with the same types of punches and dies. To accommodate the increased height of the 'work piece' the pockets 224 in the feed wheel are defined by an upper part which embraces the bottom of the neck, and a lower wheel part 224A which embraces the container body upward from its bottom. In addition, the outside guiding rail 235 may be increased in height (or doubled or tripled in number) to provide guidance to the taller container bodies Thus, the present invention provides methods and apparatus for making the end member of a container end, which methods and apparatus are adapted to a large variety of containers comprising a reclosable cap and a variety of different container body types, e.g. unitary, two piece, three piece, and made from a variety of suitable metals. The various punches, dies, and related equipment, associated with the tooling stations disclosed, form a means for accomplishing the various steps described above so as to manufacture the container end members on a mass production basis.

While the methods herein described, the forms of apparatus for carrying these methods into effect, and the resultant containers, constitute preferred embodiments of this invention, it is to be understood that the invention is not limited to these precise methods and forms of apparatus and articles, and that changes may be made in either without departing from the scope of the invention.

What is claimed is:

1. A method of forming multiple thread lugs around and protruding outward from a neck for a container, the neck having a pour opening for container contents, comprising:

entering thread lug punches into the neck through said openings;

locating thread lug dies about the exterior of the neck aligned with said thread lug punches inside the neck;

pivoting the thread lug dies by the thread lug punches about respective pivot axes; and, pressing the thread lug punches and the thread lug dies toward each other and against the neck to reform portions of the wall of the neck into a plurality of circumferentially extending and circumferentially spaced apart thread lugs projecting outwardly from the neck in predetermined alignment about the neck and at a predetermined spacing from the pour opening.

2. The method of claim 1, in which an outwardly extending curl is formed outward of the neck to define the pour opening.

3. The method defined in claim 1, including the steps of forming a dome region for the upper end of the container;

forming a neck extending upwardly of the dome region including an opening at the top of the neck defined by a lip; and forming a curl on the neck lip around the opening.

4. The method defined in claim 3, including the steps of operating the punches and dies with a rotary cam device to produce a continuing stream of product with thread lugs formed in the necks.

5. The method defined in claim 3, including the steps of operating the punches and dies with a reciprocating press mechanism.

6. The method defined in claim 5, wherein the reciprocating press mechanism includes multiple punch and die sets comprising thread lug forming mechanisms, including the steps of:

feeding container workpieces including necks from a supply stream thereof into the plural thread lug forming mechanism; and carrying away the workpieces with the thread lugs formed in the necks thereof.

7. Apparatus for forming thread lugs on a neck for a container end, the neck having a curl defining a pour opening for container contents, comprising:

cooperating punch and die tooling means configured for forming more than two, circumferentially spaced multiple thread lugs around and protruding outward from said neck by reforming portions of the wall of said neck into more than two circumferentially extending, circumferentially spaced apart lugs projecting outwardly from said neck in predetermined alignment about said neck and at a predetermined spacing from said curl;

said punch and die tooling means being operatively supported in a tool holder having a central opening;

a set of arms suspended in said central opening on respective pivots defining inward and outward motion of said punch and die tooling means between a retracted position surrounding the neck and a forming position pressing together against opposite side of the neck to reform the neck material into predetermined thread lug configuration;

means for supporting said container neck in a predetermined position; and, cooperating thread lug forming means for locating said tool holder around the neck, bringing the punch and die tooling means into contact with the neck at a predetermined distance from said curl, and retracting the punch and die tooling means upon formation of a set of thread lugs in the neck.

8. Apparatus as defined in claim 7, further including means associated with said supporting means for supplying container parts to said tool holder for addition of thread lugs and removing the completed container parts.

9. Apparatus as defined in claim 8, further including a continuous mechanism including a plurality of said thread lug forming means supported to circulate about a predetermined path including a loading station and a discharge station, means for moving said thread lug forming means about said path in a direction from said loading station to said discharge station, a cam system associated with said path and contacting said plurality of thread lug forming means to control their opening and closing functions and conveyor means for supplying container parts to said loading station and for removing container parts from said discharge station.

10. Apparatus as defined in claim 7, further including reciprocating mechanism including a press having a ram and at least one thread lug forming station supported from said ram press to process necked container workpieces;

means defining a predetermined path to and from said lug forming station, including a loading station and a discharge station; and, conveyor means coordinated with the operation of said ram for supplying container parts to said loading station and for removing container parts from said discharge station.

11. Apparatus as defined in claim 7, further including a reciprocating mechanism including a press having a ram and a plurality of thread lug forming stations supported from said ram press to process necked container parts;

means defining a predetermined path to and from said thread lug forming stations, including a loading station and a discharge station;

conveyor means coordinated with the operation of said ram for supplying container parts to said loading station and for removing container parts from said discharge station;

said conveyor means including an in-feed conveyor handling rows of container parts;

an escapement mechanism for separating the leading container parts in the in-feed conveyor from succeeding container parts;

a platform extending into said press beneath said ram and the thread lug forming stations and outwardly of said press to said escapement mechanism;

a feed wheel mechanism rotatably mounted over and in close proximity to said platform and including a plurality of peripheral pockets dimensioned to partially embrace said container parts at the base of the necks thereon;

said a pockets being located to receive the leading container parts from said escapement mechanism;

an indexing drive operated in synchronism with said press ram and connected to index said wheel mechanism in predetermined increments;

a curved rail on said platform extending around said pockets from said escapement mechanism and past said thread lug forming stations to define a path for the outer edges of the container parts placed in said pockets; and, means forming a discharge passage from said rail at least to the edge of said platform.

* * * * *